US006669314B1

(12) United States Patent
Nemec et al.

(10) Patent No.: US 6,669,314 B1
(45) Date of Patent: Dec. 30, 2003

(54) MODULAR MOBILE STORAGE SYSTEM

(75) Inventors: Brian R. Nemec, Delavan, WI (US); Steven L. Janson, Deerfield, WI (US); Fraser D. Houghton, Lake Mills, WI (US); John R. Edwards, Nobleton (CA)

(73) Assignee: Spacesaver Corporation, Fort Atkinson, WI (US)

( * ) Notice: Subject to any disclaimer, the term of this patent is extended or adjusted under 35 U.S.C. 154(b) by 0 days.

(21) Appl. No.: 09/877,942

(22) Filed: Jun. 8, 2001

(51) Int. Cl.[7] ..... A47B 53/00

(52) U.S. Cl. ..... 312/201

(58) Field of Search ..... 312/198, 199, 312/200, 201; 104/242, 248; 211/162

(56) References Cited

U.S. PATENT DOCUMENTS

| | | | | |
|---|---|---|---|---|
| 3,801,176 A | | 4/1974 | Higbee | |
| 4,417,524 A | * | 11/1983 | Quinn et al. | 104/287 |
| 4,422,816 A | * | 12/1983 | Naito et al. | 108/20 |
| 4,461,519 A | * | 7/1984 | Hildebrandt et al. | 312/223.6 |
| 4,467,924 A | * | 8/1984 | Morcheles | 104/287 |
| 4,618,191 A | * | 10/1986 | Peterman | 104/248 |
| 4,789,210 A | * | 12/1988 | Weiss et al. | 312/201 |
| 4,802,622 A | | 2/1989 | Homan | |
| 4,911,507 A | * | 3/1990 | Leist | 312/201 |
| 5,013,101 A | * | 5/1991 | Muth | 312/201 |
| 5,062,535 A | | 11/1991 | Potter | |
| 5,205,627 A | | 4/1993 | Davison et al. | |
| 5,435,639 A | | 7/1995 | Smits et al. | |
| 5,439,281 A | * | 8/1995 | Croker | 104/245 |
| 5,597,217 A | | 1/1997 | Hoska et al. | |
| 5,735,214 A | | 4/1998 | Tsuboi | |
| 5,938,047 A | * | 8/1999 | Ellis et al. | 211/1.57 |
| 5,967,346 A | | 10/1999 | Price, Jr. | |
| 6,158,601 A | | 12/2000 | Baker et al. | |

OTHER PUBLICATIONS

"More Files, Less Space", Borroughs, Published at Least One Year Before Jun. 8, 2001.
Roll–X, 1998 Holga Brochure.
Kardex Kompakt Movable Shelving System Brochure, Kardex Systems,Inc., Marietta, Ohio 45750, 1999.
Performance Specifications For Uni~Pakt High Density Mechanically Assisted Mobile Storage Systems With Shelving, 1999.
Kwik–File Mobile Aisle Brochure and Price List, Kwik–File Storage Systems, 1000 Allview Drive, Crozel, VA 22932, 1999.
Kwik–File Movable Files Brochure, Kwik–File Storage Systems, 1000 Allview Drive, Crozet, VA 22932, 1999.
Kwik–File Series 90 Cabinets Brochure, Kwik–File Storage Systems, 1000 Allview Drive, Crozet, VA 22932, 1999.
"High Density Storage And Filing Systems QuadraMobile", Montel, 1998.

(List continued on next page.)

*Primary Examiner*—Janet M. Wilkens
(74) *Attorney, Agent, or Firm*—Boyle, Fredrickson, Newholm, Stein & Gratz, S.C.

(57) ABSTRACT

A mobile storage system includes carriages mounted to rails supported on a floor, for mobilizing storage units such as drawer-type file cabinets. Each carriage incorporates mobile housing assemblies interconnected by a cross-brace arrangement. One end of the carriage includes an end panel arrangement that overlies a sidewall of an endmost storage unit, and which includes a frame and one or more cover members demountably secured to the frame so as to conceal the sidewall of the endmost storage unit. Each carriage includes retainers that interact with one of the rails so as to prevent upward movement of the carriage relative to the rails, and also function to mount one of the storage units to the carriage. The carriages and the rail and floor system are modular, enabling the components of the system to be shipped knocked-down and assembled on site, and to be expanded or contracted after installation.

66 Claims, 14 Drawing Sheets

OTHER PUBLICATIONS

Aurora Mobile Brochure, Richards–Wilcox, 600 South Lake Street, Aurora, IL 60506, Published at Least One Year Before Jun. 8, 2001.

Get On Track For Growth, Tab, 1400 Page Mill Road, Palo Alto, CA 94304, Published at Least One Year Before Jun. 8, 2001.

"EXPRESS–TRAC The Value Storage Solution", TAB, www.tab.com, 2001.

"TAB SIDE–TRAC Mobile Cabinet System" Brochure, Tab, 1400 Page Mill Road, Palo Alto, CA 94304 Published at Least One Year Before Jun. 8, 2001.

"High Density Storage And Filing Systems QuadraMobile . . . an evolutionary concept." Montel Published at Least One Year Before Jun. 8, 2001.

* cited by examiner

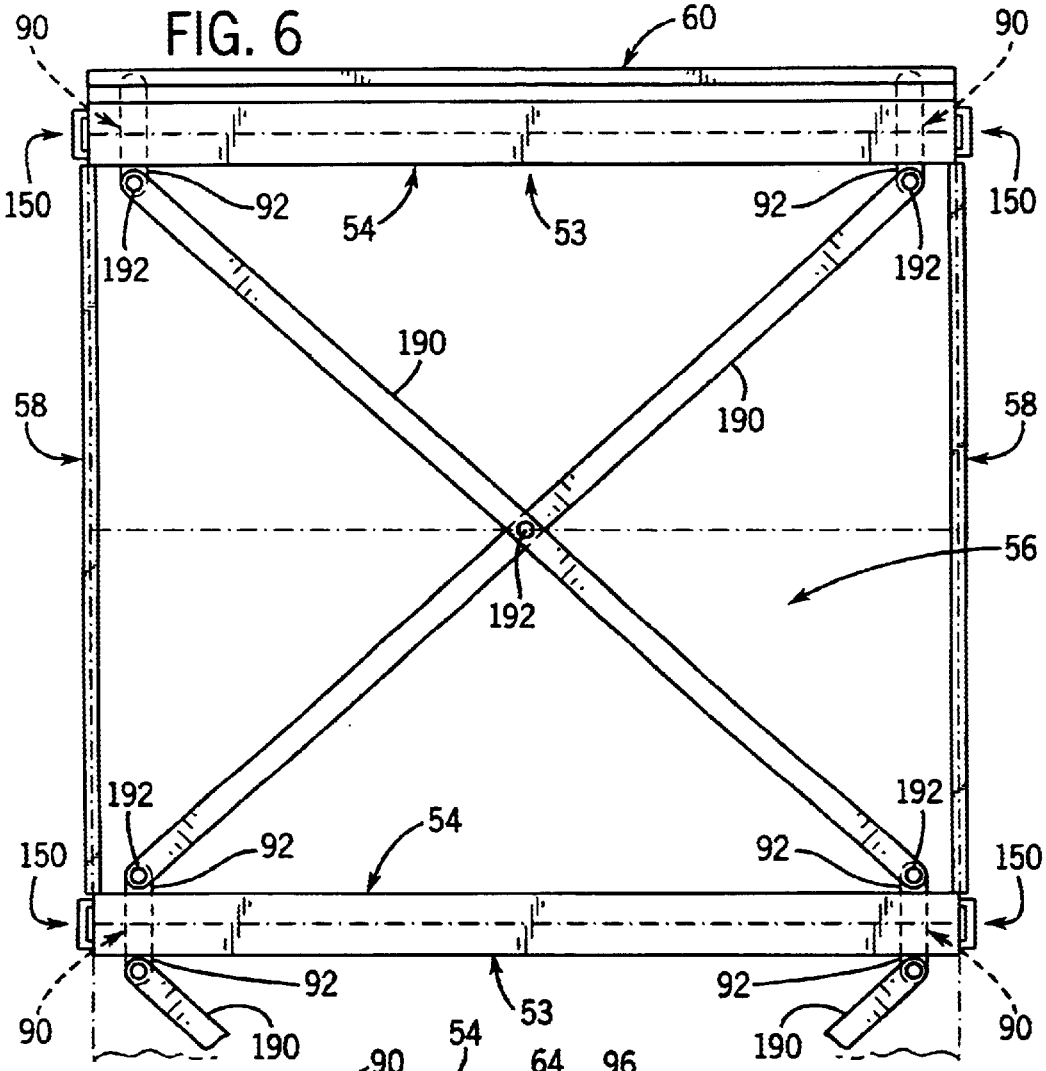
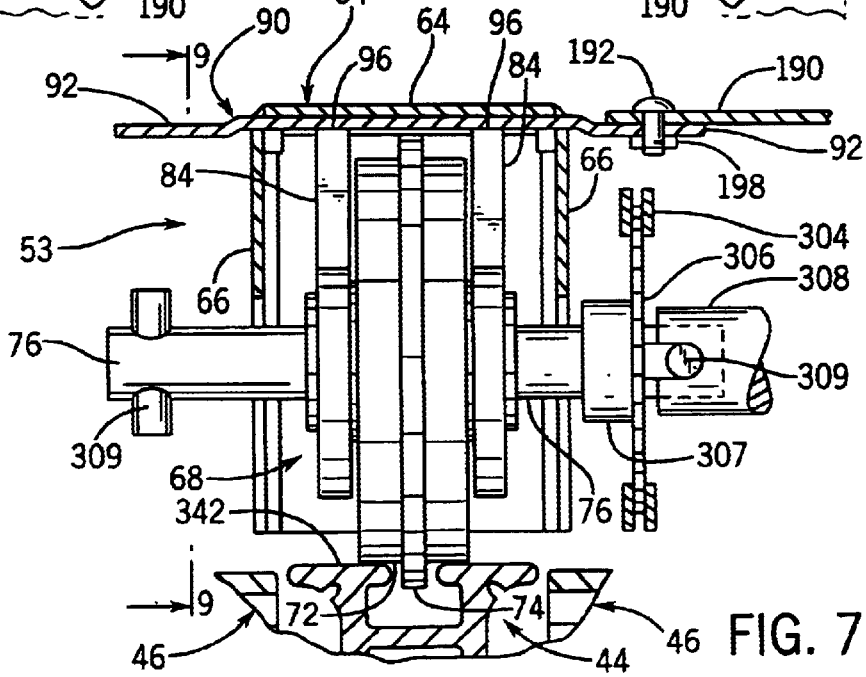
FIG. 7

MODULAR MOBILE STORAGE SYSTEM

BACKGROUND AND SUMMARY

This invention relates to a mobile storage system, and more particularly to a modular-type mobile storage system which is particularly well suited for use with storage units such as file cabinets.

High density open shelf mobile storage systems are commonly used when it is desired to increase the storage capacity in a given area over that which is attainable using fixed shelving. A typical mobile storage system employs a series of mobile platforms or carriages providing shelves, which are movably supported on a series of parallel rails. The carriages extend across the rails, and a number of storage units are mounted to and movable with each carriage. By allowing the shelves to move, the aisle space normally required between each shelf for access to the shelves may be eliminated for all but one pair of shelves. This single aisle space may be shared among pairs of shelves by movement of the shelves along the rails.

The storage units are in the form of open file shelves or bookcases. In keeping with the desire to maximize storage efficiency, the shelves are normally made as tall as possible for the given application. Each carriage is manufactured in a predetermined length corresponding to the length of the number of storage units which are to be mounted to the carriage. The system is designed to provide a certain number of rails, which is determined by the estimated weight of the loaded storage units and the length of the carriage. The manufacturer produces and assembles the rails and carriages, the latter frequently being a unitized welded frame, which are then shipped to the installation site where the system is installed by specialized, trained installers. In most cases, installation includes mounting the rails to the floor, securing the shelving units to the carriages, and movably mounting the carriages to the rails. The carriages are movable on the rails in response to operation of any satisfactory type of drive system associated with the carriages, for selectively creating an aisle between adjacent storage units so as to provide access to items stored on the shelves.

This type of mobile storage system functions well for applications in which open bookcases or side-tab type filing shelves are being converted to a mobile storage system, for example, in an industrial or warehouse type environment. Modern office environments, however, normally use so-called "top tab" type files arranged in conventional drawer type file cabinets. Use of current mobile storage systems requires the user to convert his or her files from top-tab files to side-tab files. This conversion entails significant time, inconvenience and expense both in converting the existing files and in replacing the file cabinets with storage shelves. Ideally offices seeking a high density storage system could obtain such a solution through their furniture supplier. Unfortunately, installation of conventional mobile storage systems is carried out by specially trained personnel, especially in installations in which the rails are grouted to the floor of the installation site. Furniture suppliers do not normally have access to personnel suitably trained for the installation of conventional mobile storage systems.

The present invention addresses these problems by providing a practical mobile storage system for conventional drawer-type file cabinets. The invention includes a kit that works with standard file cabinets and that may be flexibly adapted to standard file cabinets and installed in a variety of standard office settings by office furniture retailers. The simple reduced height structure is compatible with the open environment of a modern office and with the top tab files used predominantly by such office workers. Decorative end panels incorporating drive controls and canopies further adapt the file cabinets to mobile operation in a centralized pod configuration.

It is thus one object of the invention to provide a mobile storage system for file cabinets. It is another object of the invention to provide such a system which incorporates carriage and rail components which are modular in nature, and thus can be assembled in various configurations according to the specific dimensions of each storage area and the number and size of storage units to be mobilized. It is a further object of the invention to provide such a mobile storage system which can be easily assembled and installed on site, without the need for special tools or specially trained labor typically required to install a conventional mobile storage system. A still further object of the invention is to provide such a mobile storage system which is especially well suited for use in an office environment to collect and mobilize files in a centralized or regionalized area, to provide easy access to materials contained in file cabinets which otherwise may be scattered throughout an office. Another object of the invention is to provide such a mobile storage system in which the size and configuration of the components can be readily expanded, retracted or otherwise altered according to the requirements of the user. Yet another object of the invention is to provide such a mobile storage system having a number of unique features that facilitate its use in a wide range of applications for mobilizing any number of storage units, and which also facilitate assembly and installation of the components of the mobile storage system.

In accordance with the invention, a mobile storage system generally includes a series of carriages which are movably mounted to a series of rails which are supported on a surface such as a floor. A series of storage units, such as drawer-type file cabinets, are adapted to be engaged with each carriage, and are movable on the rails along with the carriages. In a typical application, a number of carriages are mounted to the rails, and the carriages can be selectively moved toward and away from each other so as to selectively create an aisle between adjacent carriages to provide access to items contained within the file cabinets.

Each carriage is modular in construction and incorporates a series of mobile housing assemblies, each of which is movably supported on one of the rails. Each mobile housing assembly preferably includes a pair of spaced apart wheels, which are supported by and movable on one of the rails. A structural cross-brace arrangement extends between and interconnects adjacent mobile housing assemblies. The structural cross-brace arrangement is preferably in the form of a pair of brace members which define an x-type configuration, and each brace member is connected between opposite ends of each of a pair of adjacent mobile housing assemblies. The brace members function to provide lateral stability to the carriage so as to stabilize the storage units during movement of the carriage.

At least one end of the carriage includes an end panel arrangement which overlies a sidewall of an endmost one of the storage units. The end panel arrangement includes a frame which is mounted to the carriage and to the sidewall of the endmost storage unit. The frame defines an interior, and one or more cover members are demountably secured to the frame so as to selectively cover the frame interior and to conceal the sidewall of the endmost storage unit. The one or more cover members can be selectively removed and replaced with other cover members, so that the user can change the aesthetic appearance of the end panel arrangement to enable the system to blend into the environment and decor of the space within which the system is situated.

A series of retainer members are interconnected with each carriage and interact with the rails so as to prevent upward movement of the carriage relative to the rails, to thereby prevent tipping of the cabinets. In a preferred form, a retainer member is secured to each end of each mobile housing assembly. Each retainer member defines a transverse retainer tab received within a groove defined by the underlying rail, and a pair of lips overlie the groove and engage the retainer tab so as to prevent upward movement of the retainer tab relative to the rail. In addition, each retainer member further includes a storage unit mounting section which extends upwardly relative to the mobile housing assembly, and which is secured to at least one of the storage units supported by the mobile housing member. In this manner, each retainer member functions to tie the storage unit to the carriage, and also provides the means by which upward movement of the carriage relative to the rail is prevented.

The rails are provided in sections which can be spliced together to form a complete rail assembly having a length as required according to the specific installation. The rails may be positioned at a desired spacing and anchored directly to the floor, or may be interconnected together by floor members located between adjacent rails. In the latter version, an engagement arrangement is interposed between the rails and the floor members, and the floor members function to space the rails a predetermined distance apart from each other according to the distance between the mobile housing assemblies of the carriage. With this arrangement, a rail and floor assembly can be built up and configured according to the dimensions and configuration as desired by the user.

The various aspects of the invention can be employed individually or in various subcombinations in order to enhance or improve upon certain characteristics of a mobile storage system. In a particularly preferred embodiment, however, the features of the invention are employed in combination to provide a mobile storage system which is relatively simple to construct and install, and which is capable of mobilizing various types of storage units including drawer-type file cabinets.

The invention also contemplates various methods involved in the construction and installation of a mobile storage system, substantially in accordance with the foregoing summary.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 6 is a top plan view of an end portion of one of the carriages forming a part of the mobile storage system of FIG. 1;

FIG. 7 is a partial section view through a portion of the carriage, with reference to line 7—7 of FIG. 13;

DETAILED DESCRIPTION

Figure 1:
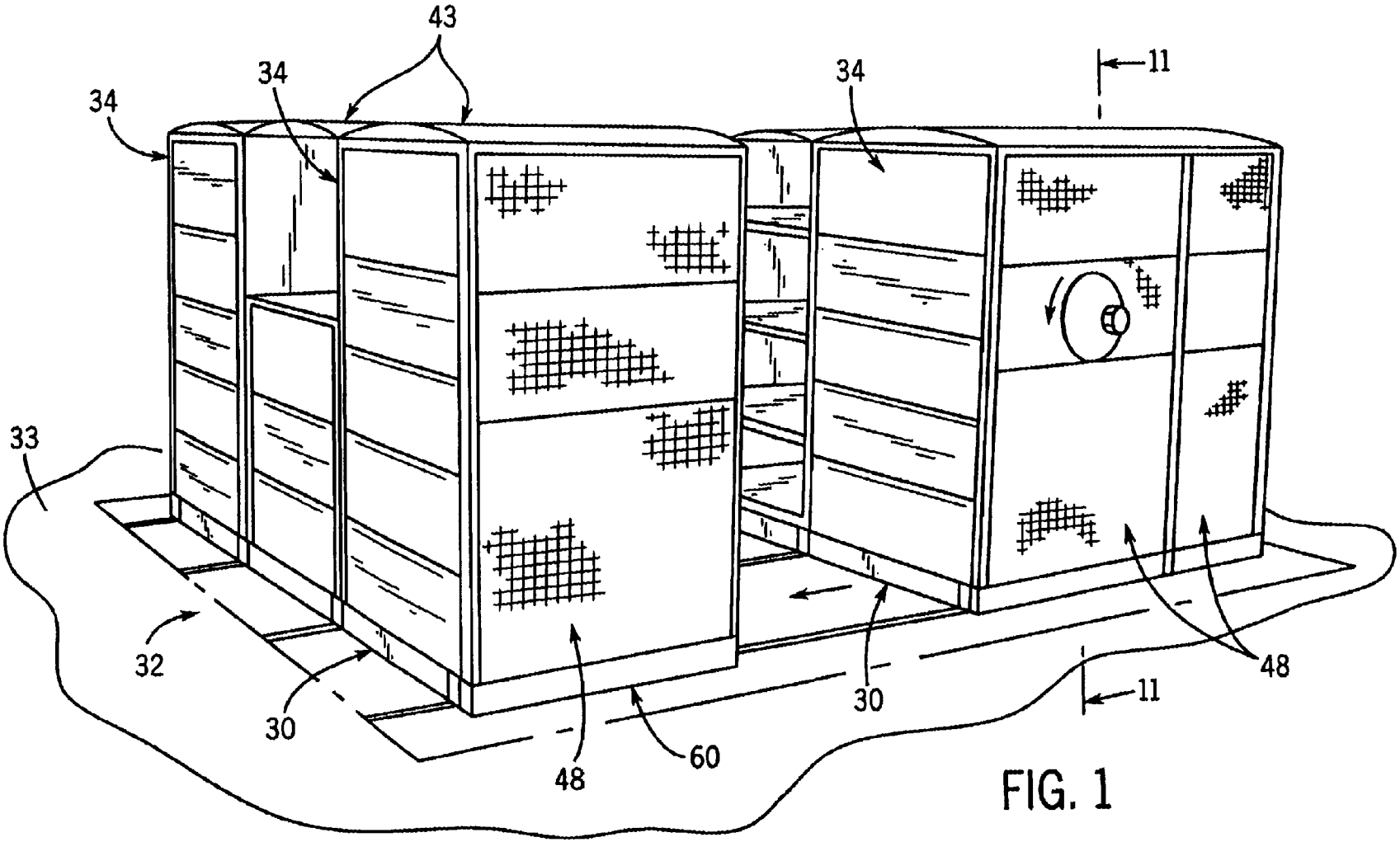
FIG. 1 is an isometric view of a representative mobile storage system assembled and installed in accordance with the present invention.
Figure 2:
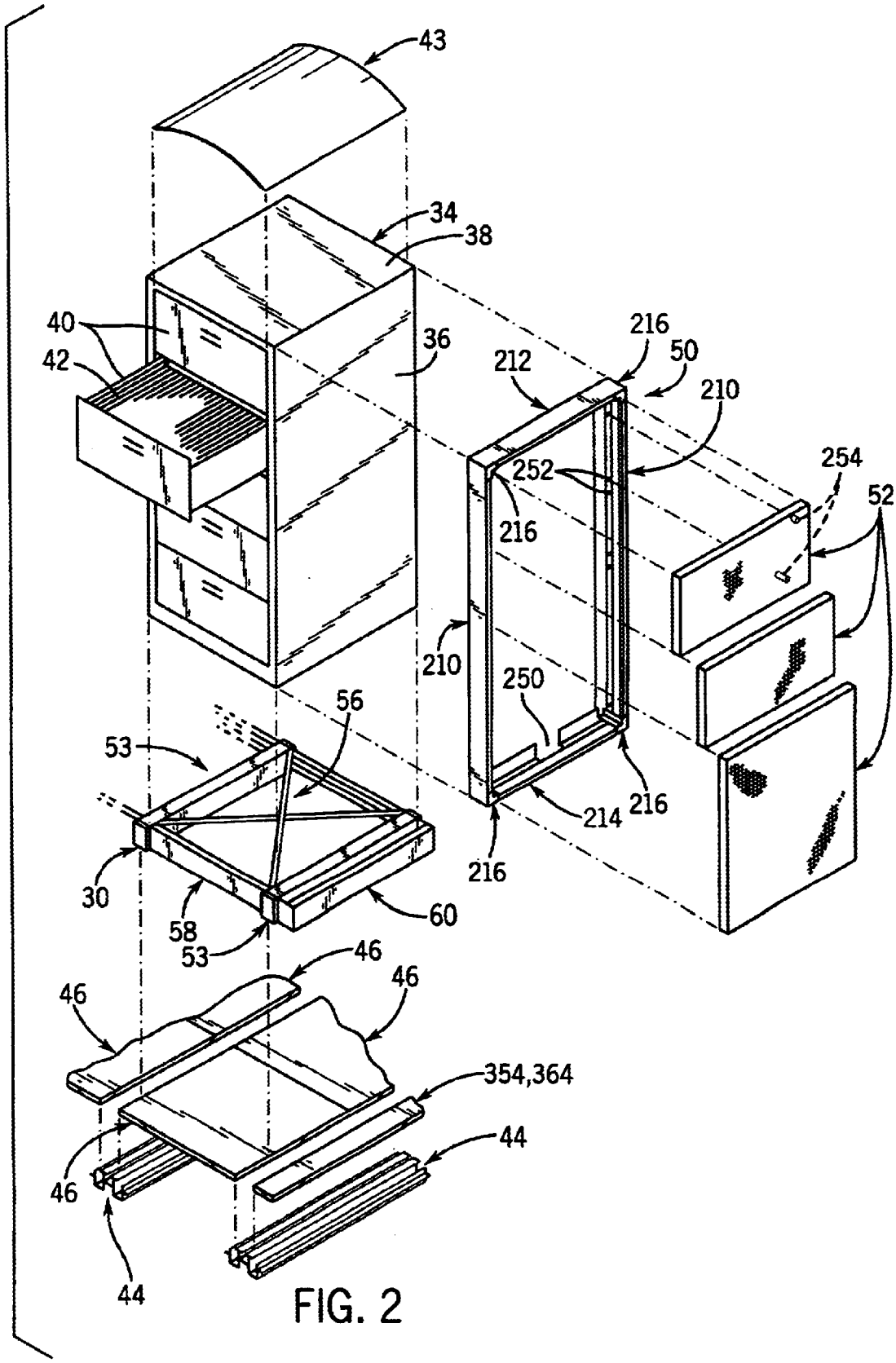
FIG. 2 is an exploded isometric view illustrating the components of the mobile storage system of the present invention in combination with a representative storage unit, such as a lateral file cabinet, adapted to be mobilized in the mobile storage system of FIG. 1.

Referring to FIGS. 1 and 2, a mobile storage system constructed according to the present invention generally includes a series of carriage assemblies 30 supported on a combination rail and floor system 32, which rests on a floor 33 or other supporting surface. Each carriage assembly 30 is adapted to support a series of storage units 34, which are illustrated as lateral file cabinets. Storage units 34 are of conventional construction, including spaced sidewalls 36, a top wall 38, bottom and back walls (not shown) typically folded and welded as a unitized whole, and an open front within which a series of drawers 40 are slidably mounted for movement between open and closed positions. The drawers may include an interlock for preventing the extension of more than one drawer at a time so as to limit the storage units tendency to topple. The storage units 34 may be obtained from a variety of commercial suppliers and normally conform to a limited number of standard dimensions including widths for letter or legal files and the present system is adapted to work with such standard storage units, including retrofitting storage units already in use by an office in a stationary arrangement. Drawers 40 are adapted to contain a series of laterally aligned top tab files 42, which are accessible when drawer 40 is moved to its open position. A series of canopy members 43 are mounted to storage units 34 above the storage unit top walls 38.

In a typical installation, the end carriage assemblies 30 are stationarily supported on rail and floor system 32, and the interior carriage assemblies 30 are movable on rail and floor system 32 for selectively creating an aisle between adjacent sets of storage units 34. While FIG. 1 illustrates a single movable interior carriage assembly 30 between the stationary end carriage assemblies 30, it is understood that any number of movable interior carriage assemblies 30 may be incorporated into the mobile storage system.

Carriage assemblies 30 are supported on rail and floor system 32, which generally includes a series of rail members 44 and a series of floor members 46 engaged with and located between rail members 44. The height of the top drawer 40 above the floor member 46 will be substantially less than six feet so as to facilitate the use of the drawers 40 with top tab files 42 by an average office worker who may thus view the contents of the drawers without obstruction. An end panel assembly 48 is located outwardly of the outer sidewall 36 of at least one of the endmost storage units 34, above carriage assembly 30. Each end panel assembly 48 generally includes a frame 50 and a series of demountable cover or tile members 52, the details of which will later be explained.

Figure 3:
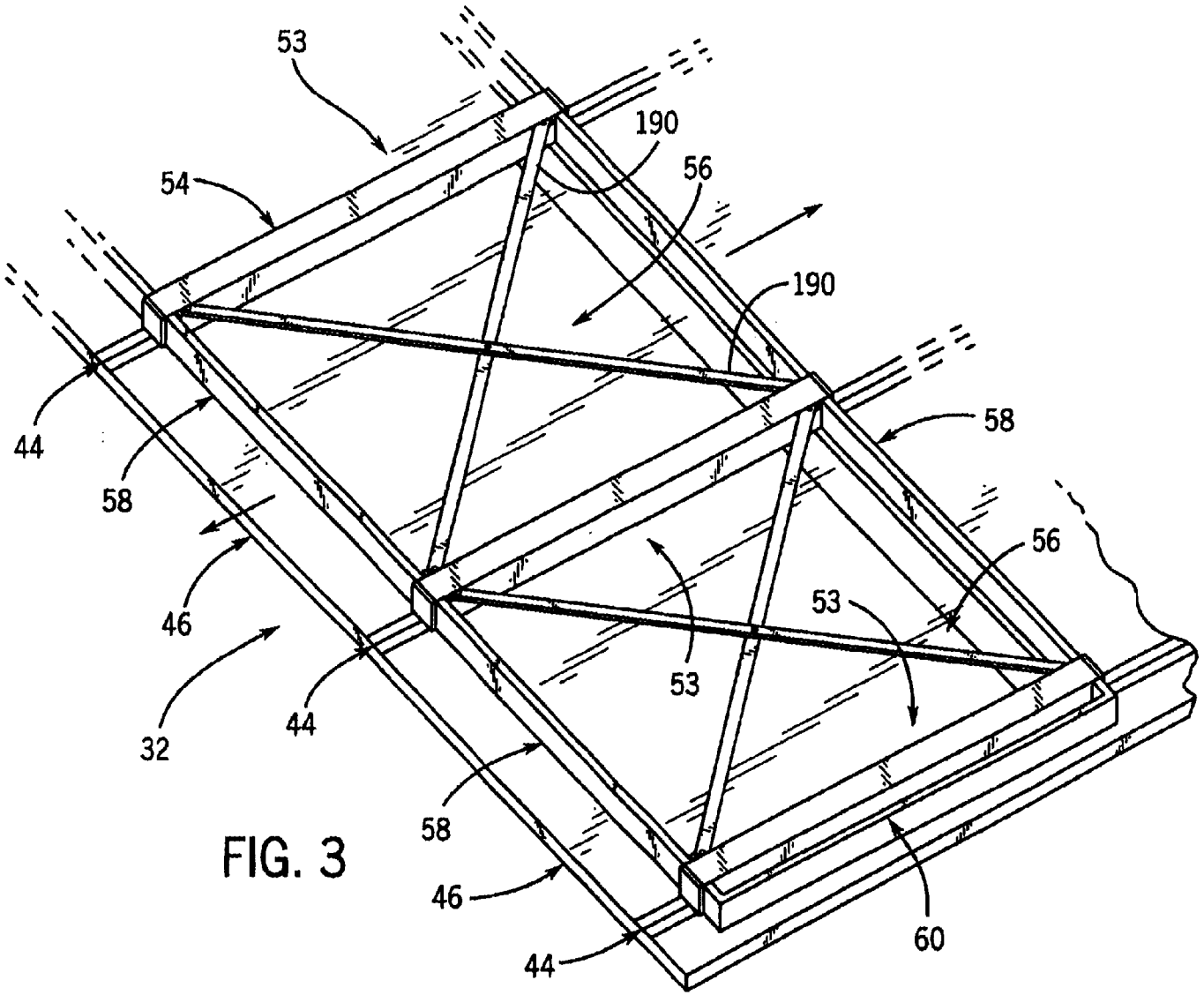
FIG. 3 is an isometric view illustrating portions of the rail system and one of the carriages incorporated in the mobile storage system of FIG. 1.

Referring to FIG. 3, carriage assembly 30 consists of a series of mobile housing assemblies, shown generally at 53, each of which includes a wheel housing member 54 in combination with a structural cross-brace arrangement 56 interconnected between each pair of adjacent mobile housing assemblies 53. In addition, a pair of side cover members 58 extend between the ends of adjacent mobile housing assemblies 53. An end cover 60 is secured to at least one of the endmost mobile housing assemblies 53 below end frame 50.

The endmost pair of adjacent mobile housing assemblies 53, in combination with cross-brace arrangement 56 and side cover members 58 extending therebetween, make up a primary "starter" module or section for carriage assembly 30. Each additional mobile housing assembly 53 is interconnected with the adjacent mobile housing assembly 53 via another structural cross-brace arrangement 56 and side cover members 58, to make up an "adder" module or section for extending the length of carriage assembly 30 a sufficient amount to support the desired number of storage units 34.

Figure 4:
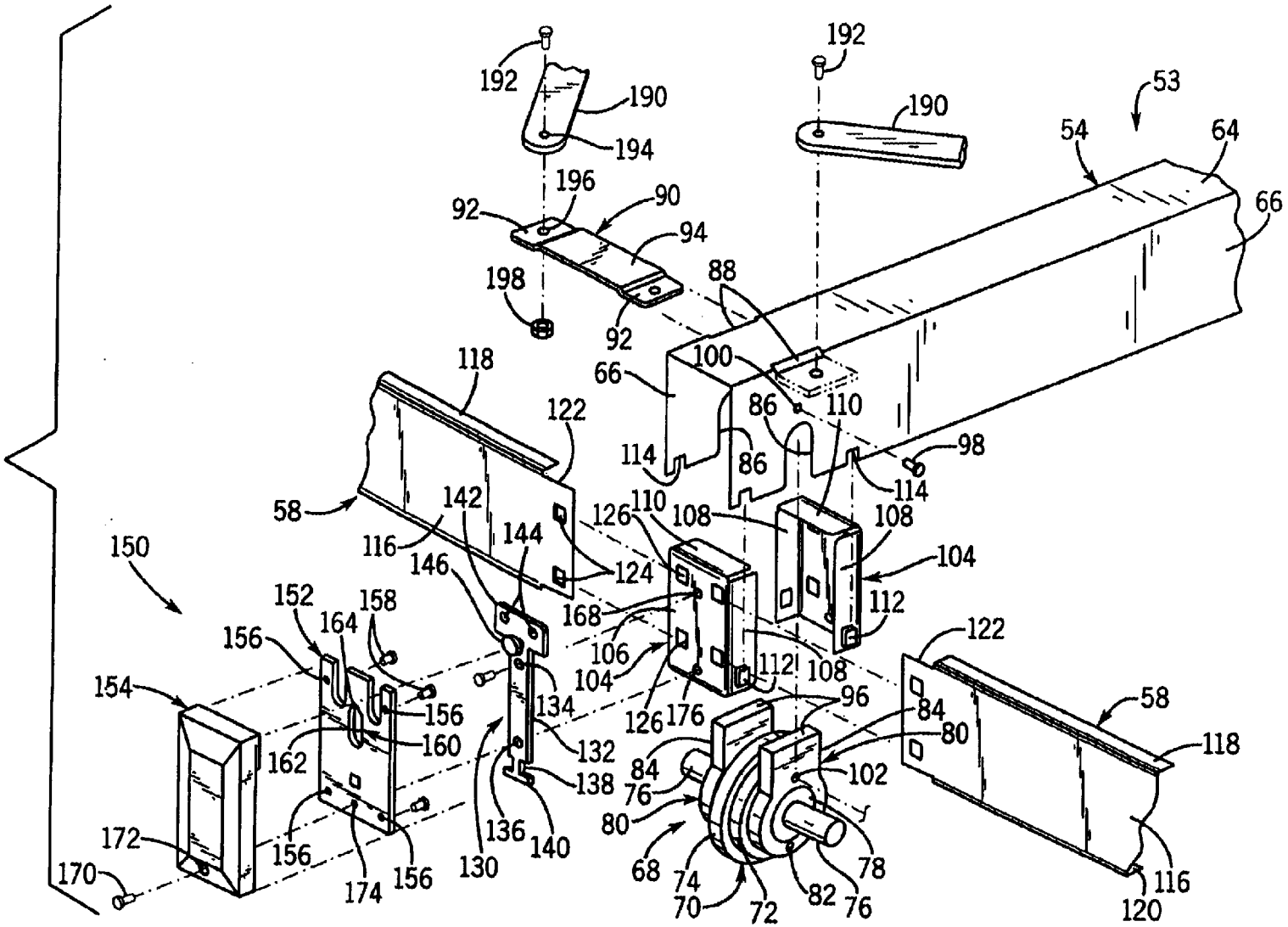
FIG. 4 is a partial exploded isometric view showing certain of the components incorporated into an interior portion of the carriage forming a part of the mobile storage system of FIG. 1.

FIG. 4 illustrates the components incorporated into one end of an interior one of mobile housing assemblies 53, with the understanding that similar components are mounted to the opposite end of mobile housing assembly 53 in a mirror image fashion. As shown in FIG. 4, wheel housing member 54 is in the form of an inverted U-shaped channel defining a top wall 64 and a pair of spaced apart depending sidewalls 66. A wheel assembly 68 is adapted for mounting to wheel housing member 54 between depending sidewalls 66.

Wheel assembly 68 includes a wheel member 70 defining a primary rolling surface 72 and an outwardly extending central guide flange 74. A pair of stub axles or shafts 76 extend outwardly from wheel 70 in opposite directions. Each stub shaft 76 extends through a bearing 78, which is supported by a bearing support 80 having a bearing engagement section 82 which encircles bearing 78. Each bearing support 80 further includes a mounting section 84 which extends upwardly from bearing engagement section 82.

A pair of aligned upwardly extending slots 86 are formed in depending sidewalls 66 of wheel housing member 54, and each slot 86 is adapted to receive one of stub shafts 76. A pair of aligned axially extending slots 88 are formed at the intersection of each depending sidewall 66 with top wall 64, and a brace retainer 90 is received within slots 88. Brace retainer 90 includes a brace engagement tab 92 at each end, with a raised central mounting area 94 located between brace engagement tabs 92. Brace retainer 90 is configured such that each brace engagement tab 92 extends outwardly of one of sidewalls 66, and central mounting area 94 engages the inner surface of top wall 64.

Referring to FIG. 7, stub shafts 76 are positioned within slots 86, and the upper edges of bearing support mounting sections 84, shown at 96, engage the underside of central mounting area 94 of brace retainer 90. A fastener 98, such as a threaded screw, extends through an aperture 100 formed in each depending sidewall 66 above the upper end of slot 86, into engagement with an aperture 102 formed in bearing support 80. In this manner, bearing supports 80 are secured to mobile housing member sidewalls 66 to secure wheel assembly 68 to wheel housing member 54. Engagement of bearing support upper edges 96 with the underside of central mounting area 94 of brace retainer 90 functions to capture brace retainer 90 in position relative to mobile housing member 54, while at the same time resisting any tendency of bearing supports 80 to rotate relative to wheel housing member 54.

A pair of wheel support members 104 are secured to wheel housing member 54 on either side of wheel assembly 68. Wheel support members 104 are identical in construction and are positioned so as to face in opposite directions. Each wheel support member 104 includes a vertical wall 106, a pair of spaced apart sidewalls 108 and a top wall 110. Each sidewall 108 includes an outwardly extending tab 112 toward its lower end, which is adapted to be engaged within one of a series of notches 114 extending upwardly from the lower edges of depending sidewalls 66. Notches 114 are arranged so that the pair of notches 114 in each sidewall 66 are located one on either side of slot 86 within which a stub shaft 76 of wheel assembly 68 is received. Engagement of tabs 112 within notches 114 functions to locate each wheel support member 104 relative to wheel housing member 54. Final assembly of each wheel support member 104 to wheel housing member 54 is carried out by any satisfactory mechanical connection means, such as by spot welding or mechanical fasteners (not shown). Alternatively, it is contemplated that sidewalls 66 may be formed with vertically spaced openings and snap-in tabs may be formed in sidewalls 108 of wheel support members 104, to provide a snap-type engagement of wheel support members 104 between depending sidewalls 66 upon upward movement of each wheel support member 104 between sidewalls 66. Wheel support members 104 function to reinforce wheel housing member 54 in the vicinity of wheel assembly 68.

Each side cover member 58 includes a vertical web 116 in combination with upper and lower flanges 118, 120, respectively. An end mounting section 122 extends from each end of web 116, and a pair of vertically spaced cut-out tabs 124 are formed in each end mounting section 122. Vertical wall 106 of the endmost wheel support member 104 includes vertically spaced pairs of apertures 126, and tabs 124 of each end mounting section 122 are adapted for engagement within apertures 126. In this manner, side cover members 58 function to connect the ends of adjacent mobile housing members 54 together, and maintain mobile housing members 54 in a vertical orientation.

A retainer member 130 is engaged with the outer one of wheel support members 104 at each end of wheel housing member 54. Each retainer member 130 includes a vertical body section 132 having an upper aperture 134 and a lower aperture 136. Retainer member 130 further includes a neck section 138 extending downwardly from the lower end of body section 132, and a transverse retainer tab 140 which extends laterally from the lower end of neck section 138. At its upper end, retainer member 130 defines a transversely extending storage unit mounting section 142 extending upwardly from the upper end of body section 132. A pair of apertures 144 are formed in storage unit mounting section 142, located one on either side of the centerline of retainer member 130. A bumper mounting projection 146 extends from the outwardly facing surface of retainer member 130, and is in the form of a conventional headed rivet secured within an aperture formed in retainer member 130. Projection 146 is in the vicinity of the intersection between the upper end of body section 132 and the lower end of transverse storage unit mounting section 142.

A bumper assembly 150, which includes a bumper mounting plate 152 and a bumper cover 154, is located outwardly of retainer member 130. Bumper mounting plate 152 includes a series of holes 156. Passages are formed in the inner side of bumper cover 154 and are adapted for placement in alignment with holes 156, and threaded fasteners, such as screws 158, extend through holes 156 and into the passages in bumper cover 154 for securing bumper cover 154 to bumper mounting plate 152. Bumper mounting plate 152 further includes a mounting opening 160 having an enlarged lower section 162 and a reduced upper section 164, and a cavity is formed in the inner surface of bumper cover 154 in the vicinity of mounting opening 160. Enlarged lower section 162 is dimensioned so as to receive the head of projection 146 of retainer member 130, and reduced upper section 164 is sized so as to receive the shank of projection 146.

In assembly, bumper assembly 150 is first assembled by securing bumper cover 154 to bumper mounting plate 152 using screws 158. Retainer member 130 is secured to mobile housing member 54 by a threaded fastener, such as a screw 166, which extends through aperture 134 and into an aligned aperture 168 formed in outer wheel support member 104. Bumper assembly 150 is then initially engaged with retainer member 130 by positioning bumper assembly 150 such that the head of projection 146 is received within enlarged lower section 162 of mounting opening 160, and bumper assembly 150 is then moved downwardly so as to engage reduced upper section 164 of mounting opening 160 with the shank of projection 146. The head of projection 146 engages bumper mounting plate 152 about reduced upper section 164 to prevent outward movement of bumper assembly 150, such that bumper assembly 150 is engaged with and suspended from projection 146. A threaded fastener, such as a screw 170, is then inserted through a lower opening 172 formed in bumper cover 154 and an aligned opening 174 formed toward the lower end of bumper mounting plate 152, and into and through lower aperture 136 formed in retainer member body section 132. Screw 170 is then engaged within an opening 176 formed in outer wheel support member 104, such that screw 170 functions to affix bumper assembly 150 and retainer member 130 to wheel housing member 54 through outer wheel support member 104.

As noted previously, a wheel assembly 68 is secured to wheel housing member 54 at each end of mobile housing assembly 53, to make up a series of wheel housing assemblies 53. While mobile housing assemblies 53 are shown and described as having wheel assemblies 68 which provide movement relative to rail and floor system 32, it is understood that any other type of mobile support mechanism may be employed in place of wheel assemblies 68, such as a track-type mechanism or sprocket-type wheels which engage openings in the rails or other support structure.

Figure 5:
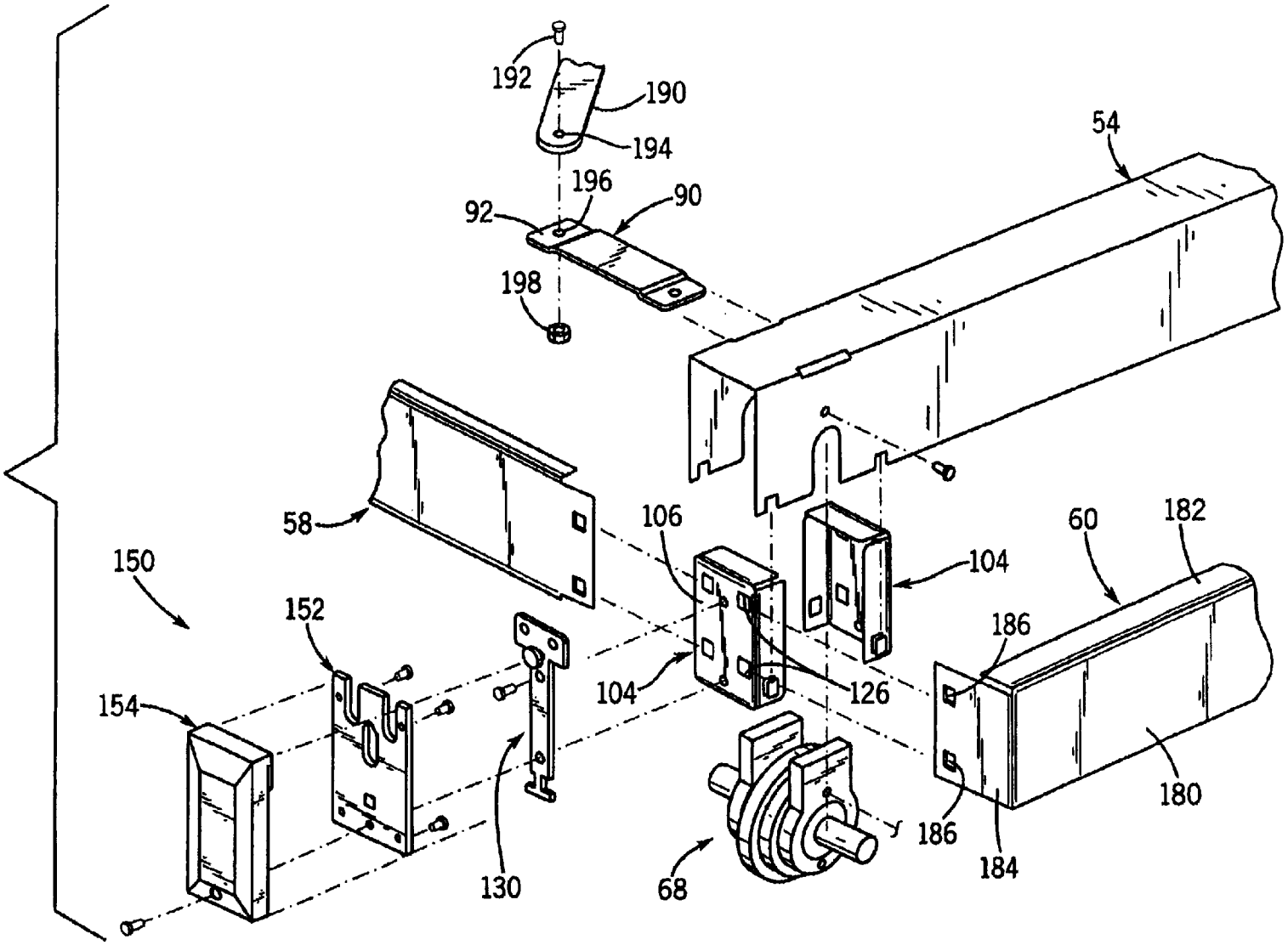
FIG. 5 is a view similar to FIG. 4, showing certain of the components incorporated into an end portion of the carriage forming a part of the mobile storage system of FIG. 1.
Figure 8:
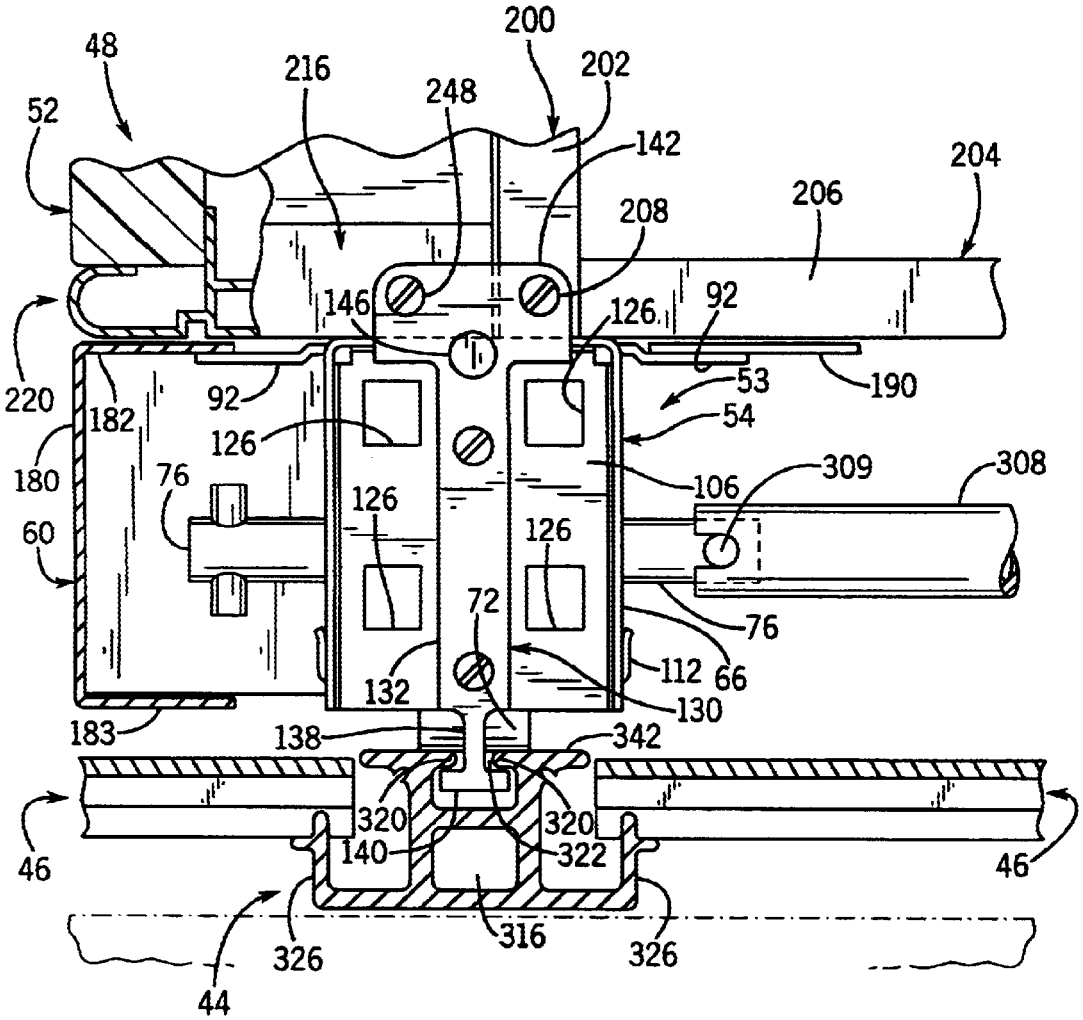
FIG. 8 is a partial section view through a portion of the carriage, with reference to line 8—8 of FIG. 13.

FIG. 4 illustrates the components interconnected with each end of each interior wheel housing member 54, which includes a pair of side cover members 58 extending in opposite directions from each end of wheel housing member 54. FIG. 5 illustrates an endmost wheel housing member 54, which has similar components mounted to its ends as each interior wheel housing member 54, including wheel assembly 68, brace retainer 90, wheel support members 104, retainer member 130 and bumper assembly 150 including bumper mounting plate 152 and bumper cover 154. A side cover member 58 extends in one direction from wheel housing member 54. At the opposite side of wheel housing member 54, an end cover member 60 is engaged with wheel housing member 54 through outer wheel support member 104. End cover member 60 includes a vertical web 180, a top flange 182 and a bottom flange 183 (FIG. 8), as well as a mounting section 184 in the form of a bent extension of vertical web 180. A pair of cut-out mounting tabs 186 are formed in mounting section 184, and are engageable within a pair of vertically spaced openings 126 in vertical wall 106 of outer wheel support member 104, in the same manner as described previously with respect to side cover members 58. In this manner, end cover member 60 is connected to wheel housing member 54 so as to extend alongside and parallel to mobile housing assembly 53 at an end of carriage assembly 30. As shown in FIG. 8, top flange 182 of end cover member 60 overlies brace engagement tab 92 which extends from the outwardly facing side of the endmost wheel housing member 54, which functions to support end cover member 60.

Referring to FIG. 6, each structural cross-brace arrangement 56 includes a pair of identical diagonal brace members 190 arranged in an x-type configuration between adjacent mobile housing assemblies 53. Each end of each brace member 190 is secured to one of brace engagement tabs 92 defined by a brace retainer 90, each of which is located adjacent one of the ends of a mobile housing assembly 53. Each brace member 190 extends between one end of a mobile housing assembly 53 and the opposite end of the adjacent mobile housing assembly 53, such that brace members 190 cross each other at the center of the space between the adjacent mobile housing assemblies 53.

As shown in FIGS. 4 and 5, the end of each brace member 190 is engaged with a brace engagement tab 92 by means of a threaded bolt 192 which extends through aligned openings 194, 196 formed in brace member 190 and engagement tab 92, respectively. A nut 198 is engaged with the threaded shank of bolt 192 for securing brace member 190 to brace engagement tab 92. In addition, brace members 190 are connected to each other at the location where brace members 190 cross each other between adjacent mobile housing assemblies 53. Each brace member 190 includes a slot at its center, and the slots overlap each other at the intersection of brace members 190. A bolt 192 extends through the aligned slots, and is engaged with a nut 198 so as to secure brace members 190 together.

At each interior mobile housing assembly 53, a pair of storage units 34 are engaged with top wall 64, such that each interior mobile housing assembly 53 functions as a common support for adjacent sides of a pair of storage units 34. At the endmost mobile housing assembly 53, shown in FIG. 8, wheel housing member 54 supports the outer end of the endmost storage unit 34, and also provides a support for end panel assembly 48.

Each storage unit 34 includes a storage unit housing within which drawers 40 are slidably mounted. Representatively, the storage unit housing includes a side panel 200 having a front flange 202, in combination with a bottom panel 204 having a front flange 206. With reference to FIG. 8, storage unit mounting section 142 of each retainer member 130 extends above the upper surface of top wall 64 of wheel housing member 54. Storage unit mounting section 142 overlaps the lower end of side panel flange 202. A threaded fastener, such as a self-tapping screw 208, extends through one of apertures 144 in storage unit mounting section 142, into engagement with flange 202 defined by side panel 200. In this manner, storage unit 34 is fastened to mobile housing assembly 53 through engagement with retainer member 130 and positively attached directly to the rail member 44 via retainer tab 140 as will be described further below. This facilitates the use of the present system with premanufactured storage units 34. At each interior mobile housing assembly 53, each adjacent storage unit 34 is fastened to a respective one of mobile housing assemblies 53 by securing the storage unit housing to storage unit mounting section 142 in a similar manner, such that storage unit mounting section 142 functions to secure both adjacent storage units 34 to one of mobile housing assemblies 53 at each end of mobile housing assembly 53.

Figure 9:
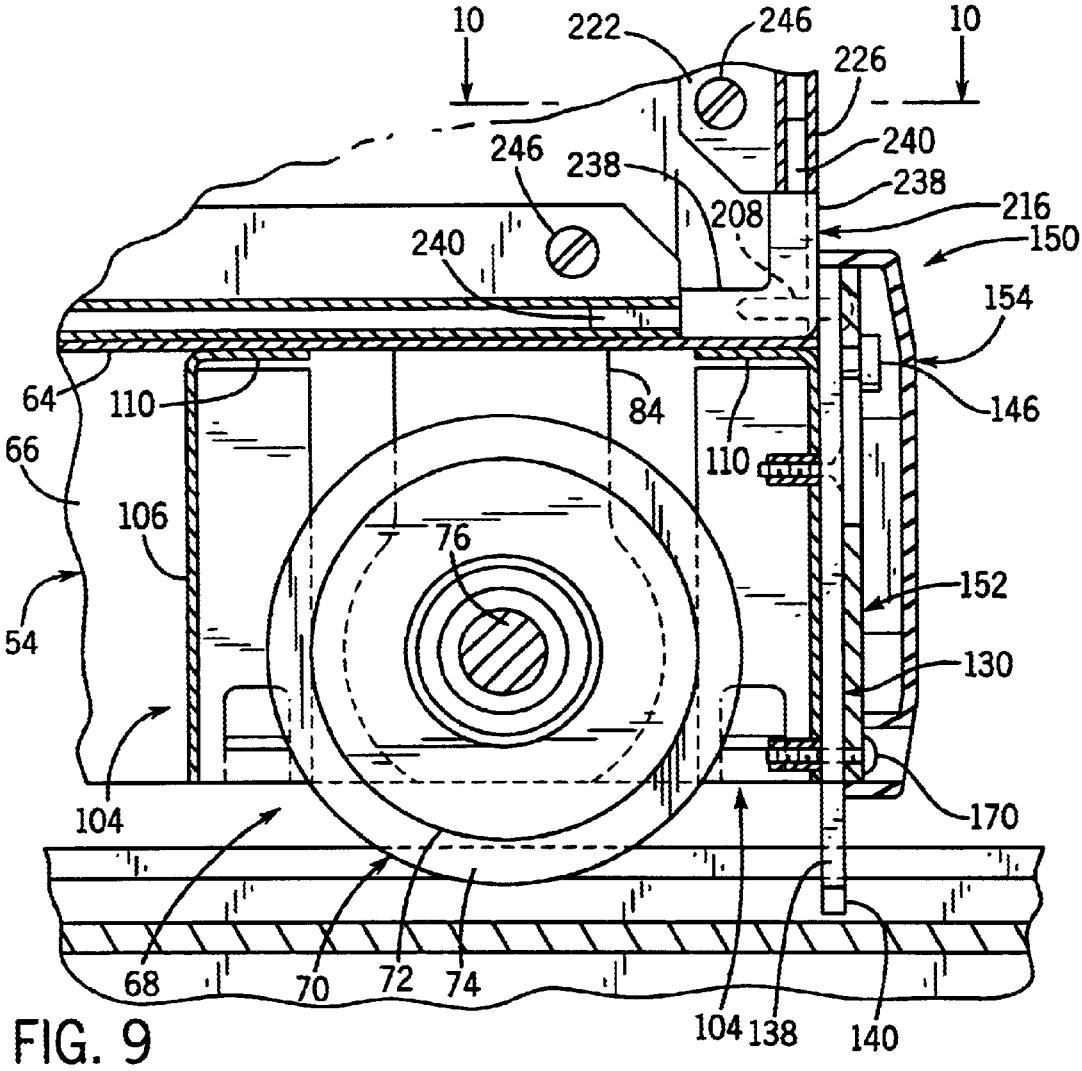
FIG. 9 is a partial section view taken along line 9—9 of FIG. 7.
Figure 10:
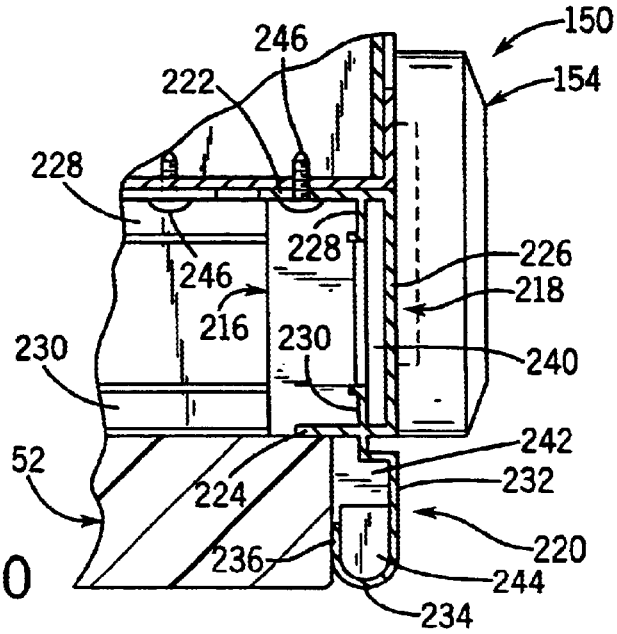
FIG. 10 is a partial section view taken along line 10—10 of FIG. 9.

Referring to FIG. 2 and FIGS. 8–12, frame 50 of end panel assembly 48 includes a pair of side frame members 210, a top frame member 212, a bottom frame member 214, and a series of corner connectors 216 located between and interconnecting the adjacent ends of frame members 210–214. Frame members 210–214 are substantially identical in cross section construction. With reference to FIG. 10, each of frame members 210–214 generally includes an inner frame mounting section 218 and an outer tile mounting section 220.

Each inner frame mounting section 218 includes an inner flange 222, an outer flange 224, and a web 226 extending therebetween. An inner engagement lip or wall 228 extends outwardly from inner flange 222, and is spaced inwardly from and oriented parallel to web 226. Similarly, an outer engagement lip or wall 230 extends inwardly from outer flange 224, and is spaced inwardly from and oriented parallel to web 226. Each tile mounting section 220 is in the form of a channel-shaped member extending outwardly from outer flange 224, defining an outer wall 232, an arcuate end 234 and an inwardly extending inner lip 236.

Each corner connector 216 includes a pair of right angle corner members 238. A connecting tongue 240 extends from the end of each corner member 238, and is engaged within the space defined between outer web 226 and inner and outer engagement walls 228, 230, respectively, defined by each of frame members 210–214. Each corner connector 216 further includes a pair of outer extensions 242, each of which has a raised protrusion 244 corresponding in shape to the channel shape defined by the outer area of tile mounting section 220. Each protrusion 244 is adapted to be received within the space defined between outer wall 232, arcuate end wall 234 and inner lip 236. With this arrangement, corner connectors 216 are engaged with the corners defined by the adjacent ends of frame members 210–214, so as to form frame members 210–214 into end frame 50 which defines a closed shape having an open interior, and which is dimensioned so as to correspond to the external dimensions of outer sidewall 36 of the endmost storage unit or units 34.

Representatively, frame members 210–214 may be formed of a material such as extruded aluminum, although it is understood that other satisfactory materials and forming methods may be employed. Corner connectors 216 may be formed of a cast aluminum material, although it is again understood that other satisfactory materials and forming methods may be employed.

Figure 11:
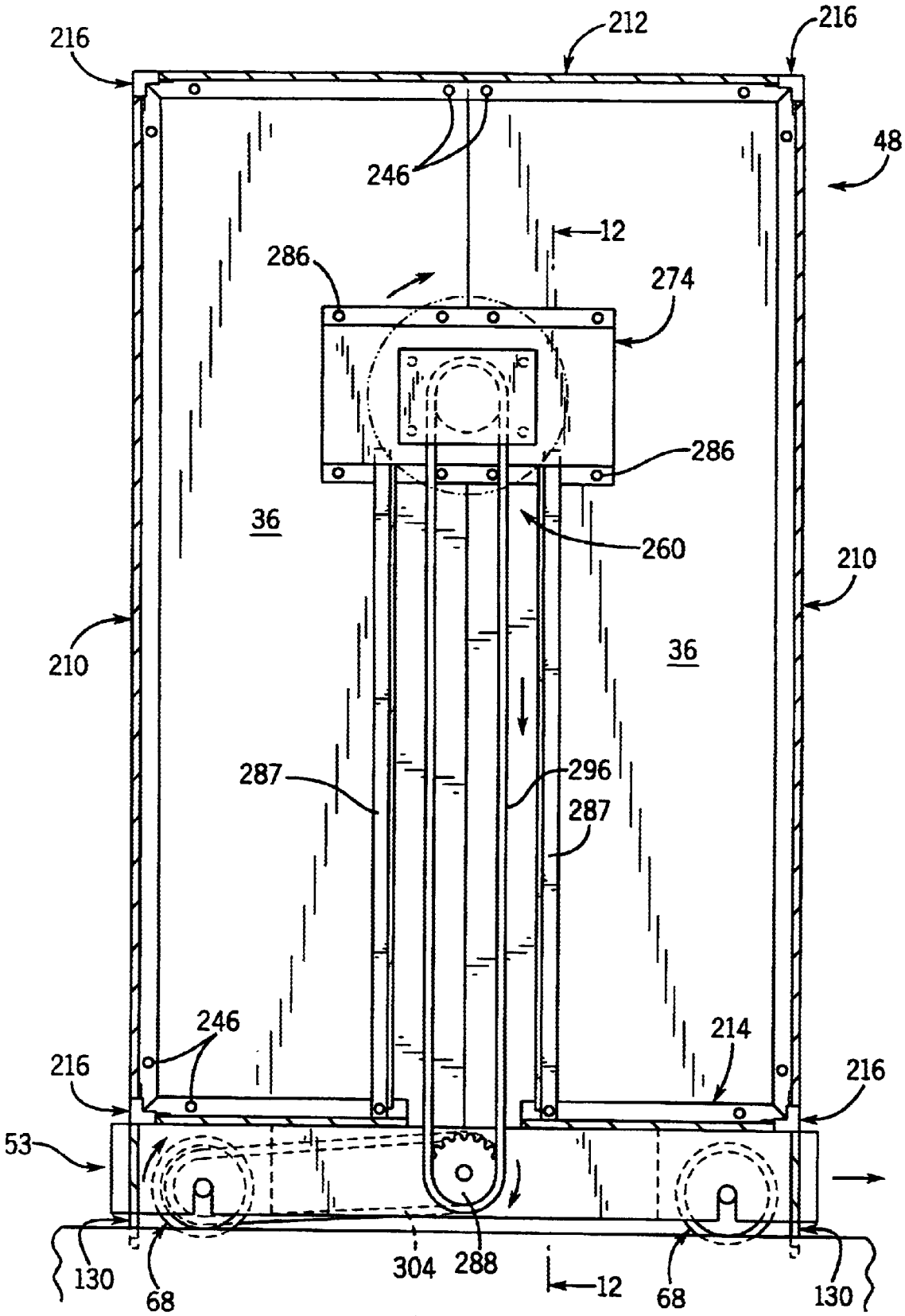
FIG. 11 is a partial section view taken along line 11—11 of FIG. 1.

Referring to FIGS. 9–11, end frame 50 is connected to outer sidewalls 36 of the endmost storage unit or units 34 by means of a series of threaded fasteners, such as self-tapping screws 246, which extend through openings formed in inner flanges 222 of frame members 210–214 and into and through storage unit sidewalls 36, so as to mount frame 50 to the endmost storage units 34. In addition, end frame 50 is interconnected with carriage assembly 30 as shown in FIG. 8, by means of a self-tapping screw 248 which extends through one of apertures 144 in storage unit mounting section 142 of retainer member 130. The threaded shank of screw 248 is received within a passage formed in corner member 238 of corner connector 216.

As shown in FIG. 2, a cut-out area 250 is formed in bottom frame member 214, forming a gap in inner flange 222, inner engagement wall 228 and the inner portion of web 226.

Tile members 52 are demountably engaged with end frame 50. A series of tile mounting openings 252 are formed in outer flange 224 at selected locations of outer flange 224 along the length of side frame members 210. Tile mounting openings 252 are adapted to selectively receive releasable clip-type tile mounting members 254 which are interconnected with and extend inwardly from the inner surface of each tile member 52. In a typical construction, each tile member 52 includes a conventional tile frame defining an open interior within which a tile core is received. A fabric or other type of upholstery or covering is applied to the outwardly facing surfaces of each tile member 52, again in a conventional manner.

With this arrangement, tile members 52 may be selectively engaged with and disengaged from end frame 50. Tile mounting members 254 cooperate with tile retaining openings 252 so as to enable each tile member 52 to be mounted to end frame 50 using a push-on motion, and removed from end frame 50 using a pull-off motion. Tile members 52 can thus be removed as desired for replacement or recovering, to allow the external appearance of end panel assembly 48 to be selected and altered according to the desires of the user.

While tile members 52 are illustrated as being engageable with end frame 50 using clip-type mounting members received within fasteners, it should be understood that any other satisfactory type of demountable or releasable engagement structure may be employed to releasably secure tile members 52 to end frame 50. For example, mating hook-and-loop strips of material may be provided on frame members 210–214 and on the rearward surfaces of tile members 52 for providing releasable mounting of tile members 52 to end frame 50. Alternatively, vertically spaced slots may be formed in outer flange 224 of each side frame member 210, and hooks may be mounted to the rearward surfaces of tile members 52 for releasable engagement within the vertically spaced slots or, separate tile mounting members may be engaged within openings defined by outer flange 224 of each side frame member 210 for receipt within slots formed in the rear surfaces of tile members 52, such as is disclosed in copending application Ser. No. 09/392,828 filed Sep. 9, 1999, the disclosure of which is hereby incorporated by reference. These examples are illustrative of any variety of ways in which tile members 52 may be demountably engaged with end frame 50.

Figure 12:
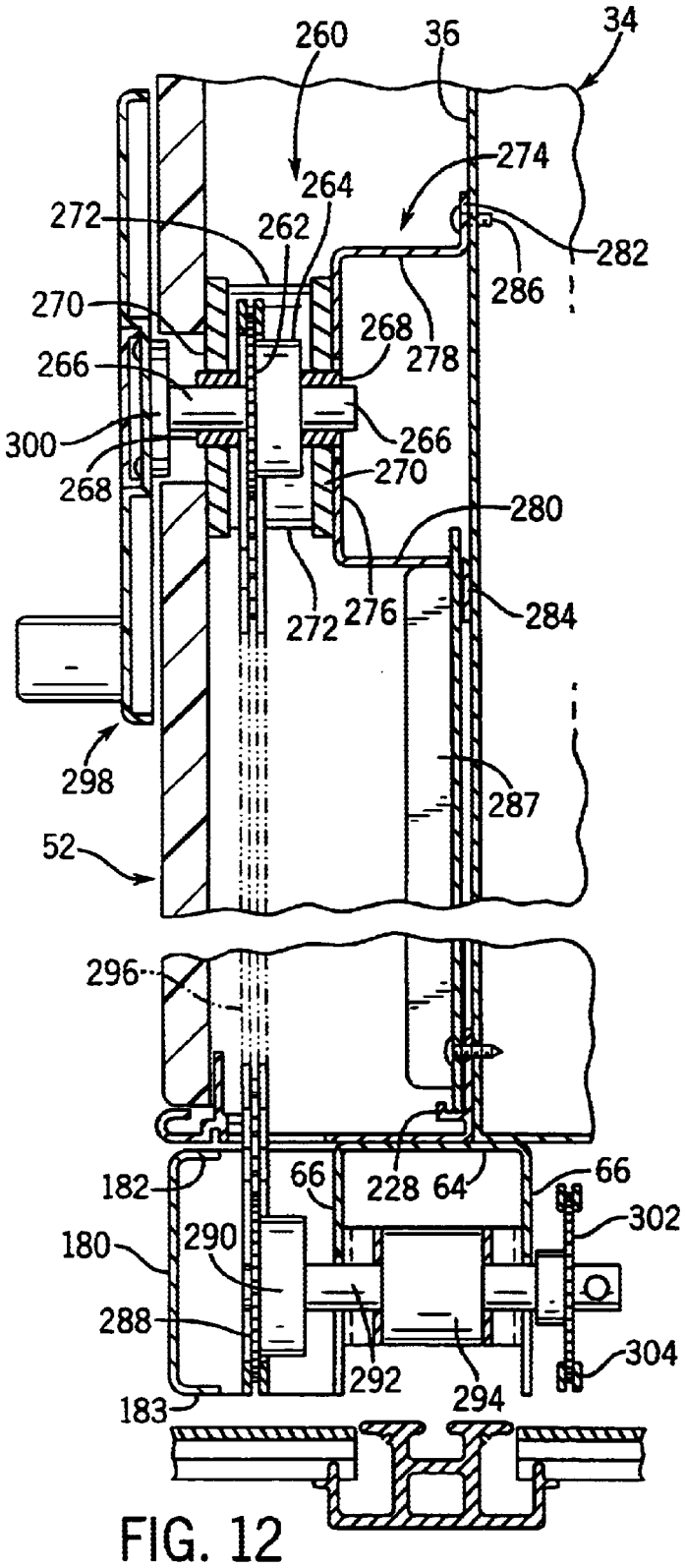
FIG. 12 is a partial section view taken along line 12—12 of FIG. 11.

As shown in FIGS. 11 and 12, an input drive arrangement 260 is interconnected with storage units 34 and each carriage assembly 30 for providing input power to move each carriage assembly 30 on rail members 44. Input drive arrangement 260 includes an input sprocket 262 secured to a hub 264, which in turn is engaged with a pair of oppositely extending stub shafts 266, each of which is rotatably supported in a bearing 268. Bearings 268 are in turn engaged with spaced apart mounting plates 270 interconnected with each other via a series of spacers 272, which make up an input sprocket subassembly that is secured to a mounting bracket 274. Mounting bracket 274 includes an outer wall 276 to which the inner mounting plate 270 is secured, such as by welding, mechanical fasteners, or in any other satisfactory manner. Upper and lower transverse walls 278, 280, respectively, extend inwardly from outer wall 276, and terminate in upper and lower flanges 282, 284, respectively. A series of fasteners 286, such as self-tapping screws, extend through upper and lower flanges 282, 284, respectively, and into the outer sidewalls 36 of storage units 34 supported by carriage assembly 30, for fixing mounting bracket 274 to storage units 34. A pair of spacer bars 287 extend between the underside of mounting bracket 274 and bottom frame member 214.

Input drive assembly 260 further includes a lower transfer sprocket 288 rotatably mounted to wheel housing member 54 below input drive sprocket 262. Lower transfer sprocket 262 is connected to a hub 290 and to a transfer shaft 292, which is rotatably supported by a bearing assembly 294 mounted between depending sidewalls 66 of wheel housing member 54. A drive chain 296 is engaged with drive sprocket 262 and transfer sprocket 288. Cut-out area 250 in bottom frame member 214 provides clearance for drive chain 296. A conventional rotating input handle 298 is fixed to outer stub shaft 266 via a mounting plate 300, such that rotation of handle 298 is operable to impart rotation to input sprocket 262 through outer stub shaft 266. Rotation of input sprocket 262 is transferred through chain 296 to transfer sprocket 288.

A lower driven sprocket 302 is mounted to transfer shaft 292 inwardly of wheel housing member 54. A drive chain 304 is engaged with lower driven sprocket 302 and with a driven sprocket 306 (FIG. 7) having a hub 307 interconnected with stub shaft 76 of wheel assembly 68. With this arrangement, wheel assembly 68 is driven in response to rotation of input handle 298 through input sprocket 262, drive chain 296, transfer sprocket 288, transfer shaft 292, lower driven sprocket 302, drive chain 304 and driven sprocket 306.

Each module of carriage assembly 30 includes a drive shaft section 308 interconnected between aligned, facing stub shaft sections 76 for transferring rotary power between wheel assemblies 68 at one end of mobile housing assembly 53, in response to rotation of input handle 298. Each end of each drive shaft section 308 includes a recess within which the end of a stub shaft 276 is received. A cross pin 309 is engaged with each stub shaft 276 and received within a notch formed in the end of drive shaft section 308, for drivingly connecting drive shaft sections 308 with wheel assemblies 68. In a preferred embodiment, each cross pin 309 is press fit into a transverse passage formed in stub shaft 76. In this manner, drive shaft section 308 is engaged with stub shaft 76 by simply inserting the end of stub shaft 76 into the recess in the end of drive shaft section 308, and positioning cross pin 309 within the notch formed in the end of drive shaft section 308.

Figure 13:
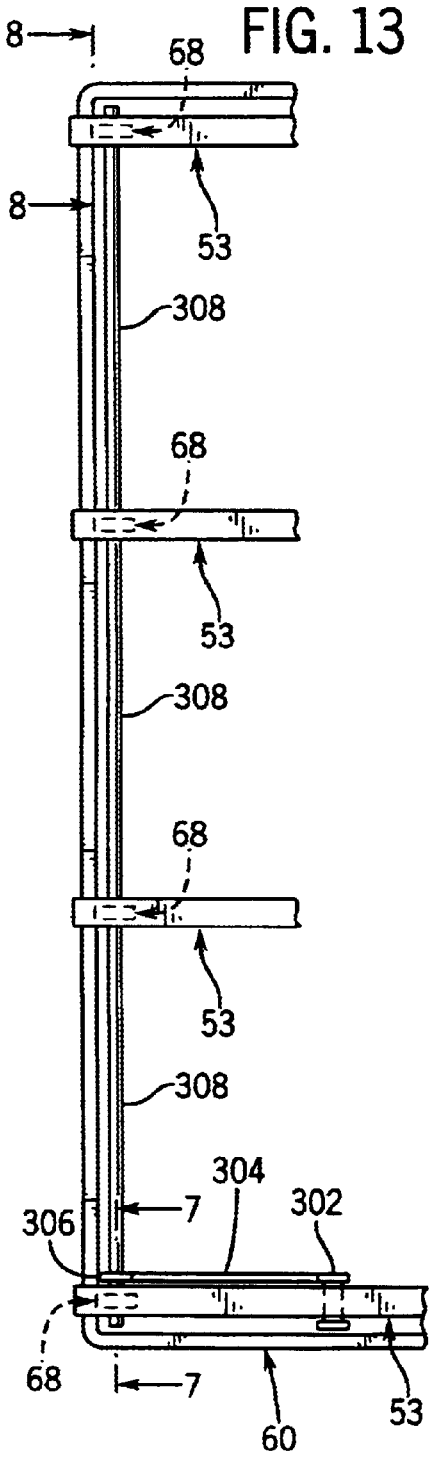
FIG. 13 is a partial top plan view illustrating the drive arrangement incorporated into one of the carriages forming a part of the mobile storage system of FIG. 1.

As shown in FIG. 13, a drive shaft section 308 extends between and is interconnected with the facing stub shafts 76 of adjacent mobile housing assemblies 53. In this manner, drive shaft sections 308 function to transfer power to mobile housing assemblies 53 in response to operation of input drive arrangement 260, to move carriage assembly 30 on rail members 44.

The drawing figures and the above description disclose a mechanical assist type of drive system for imparting movement to a movable one of carriages 30. It should be understood, however, that this type of drive arrangement is simply representative of any satisfactory drive arrangement for imparting movement to a mobile carriage in a mobile storage system. For example, the illustrated drive arrangement may be replaced with any other satisfactory type of drive system, including a manual or electrically operated system.

Figure 14:
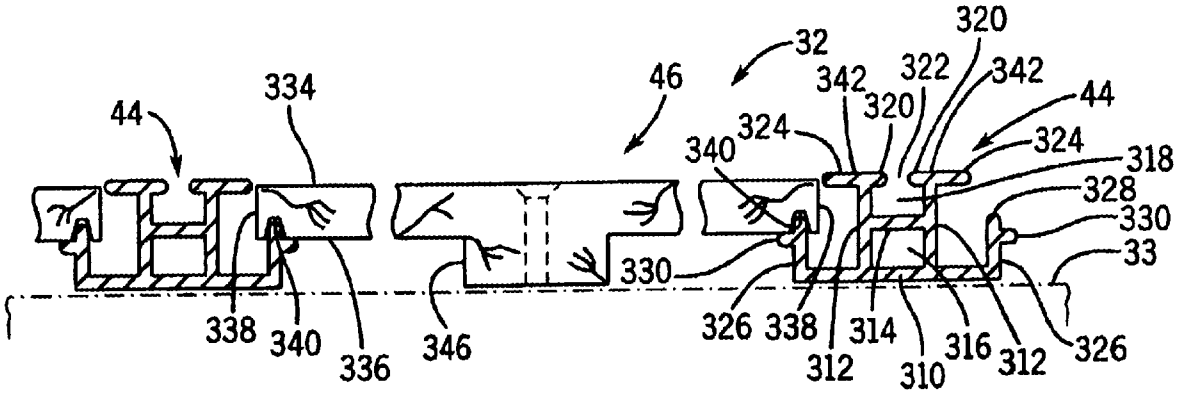
FIG. 14 is a partial section view illustrating an interior portion of the rail and floor components incorporated into a raised floor embodiment of the mobile storage system, as shown in FIG. 1.

FIG. 14 illustrates rail and floor system 32 in cross-section. As noted previously, rail and floor system 32 includes a series of parallel rail members 44 which are preferably formed in sections and spliced together to provide each rail member 44 with a desired length. In a similar manner, floor members 46 have a predetermined width and length, and are fitted together so as to provide a floor panel or area between each adjacent pair of rail members 44.

Each rail member 44 includes a transverse base 310 adapted for placement on floor 33 or any other satisfactory supporting surface. A pair of spaced apart webs 312 extend upwardly from base 310, and a transverse wall 314 extends between and interconnects webs 312. Transverse wall 314 and webs 312 cooperate to define an H-shape when viewed in cross-section. A closed passage 316 is defined below transverse wall 314, and an upwardly open channel or groove 318 is defined above transverse wall 314. An inner lip 320 extends inwardly from the upper end of each web 312, and each lip 320 overlies groove 318. A space 322 is defined between the facing inner ends of lips 320, and is in communication with groove 318. An outer lip 324 extends outwardly from the upper end of each web 312.

An upstanding floor mounting wall 326 extends upwardly from each end of base 310, terminating in an upper end 328. An outwardly extending lip 330 extends outwardly from floor mounting wall 326, spaced slightly below upper end 328 defined by floor mounting wall 326.

Each floor member 46 defines an upper surface 334 and an underside 336, as well as a pair of side edges 338 and a pair of end edges. Each floor member 46 is formed to a predetermined set of dimensions to provide a rectangular floor member 46 having a predetermined shape, size and configuration. Floor members 46 extend between and interconnect adjacent pairs of rail members 44 at a predetermined spacing relative to each other. A groove 340 is formed in underside 336 of floor member 46 adjacent each side edge 338. Grooves 340 are spaced apart from each other a constant, predetermined distance corresponding to a desired spacing between adjacent rail members 44. Each groove 340 is adapted to receive upper end 328 of one of floor mounting walls 326, and lip 330 engages underside 336 of floor member 46 inwardly of groove 340. In this manner, facing lips 330 of adjacent rail members 44 support floor member 46 so as to space floor member 46 above floor 33, and engagement of upper ends 328 of floor mounting walls 326 within grooves 340 functions to space rail members 44 apart from each other. Floor members 46 are dimensioned such that the spacing between adjacent rail members 44 is the same as the spacing between adjacent mobile housing assemblies 53 of carriages 30, such that each mobile housing assembly 53 is movably supported on one of rail members 44.

Inner lips 320 and outer lips 324 define a continuous upwardly facing wheel support surface 342 located on either side of space 322 defined by each rail member 44.

As shown in FIG. 14, sleeper strips 346 may be placed below floor members 46 so as to support floor members 46 between rail members 44. Alternatively, each floor member 46 may be provided with one or more T-nuts located within the space between floor 33 and underside 336, with threaded fasteners extending through floor member 46 and into engagement with the one or more T-nuts. With this arrangement, the threaded fasteners can be turned so as to adjust the elevation of the T-nuts, so as to engage floor 33 and to support and level floor members 46 between rail members 44.

Each floor member 46 may be formed of any satisfactory material, and representatively may be a cut section of wood, metal, plastic or composite flooring material. It is understood, however, that any satisfactory type of flooring material and forming method may be employed.

Figure 15:
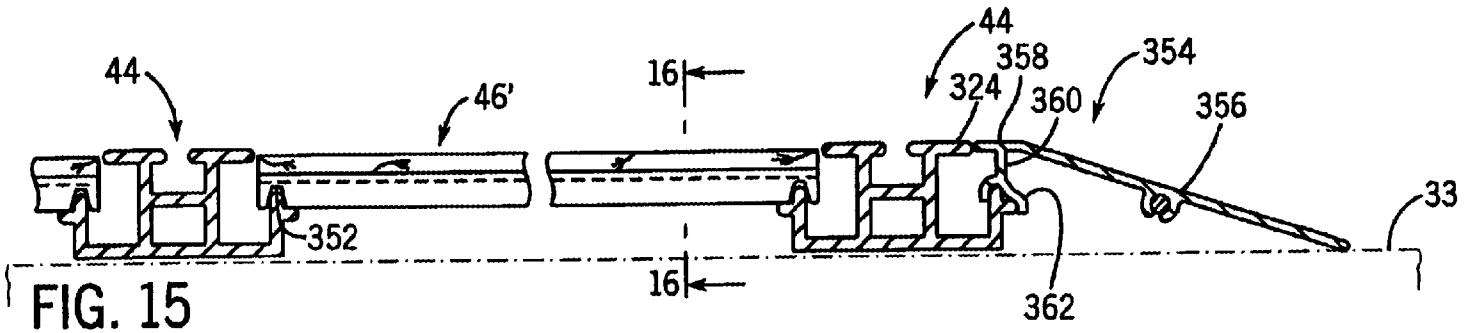
FIG. 15 is a view similar to FIG. 14, showing an alternative floor component construction and illustrating one embodiment of a ramp adapted for connection to an endmost one of the rails.
Figure 16:
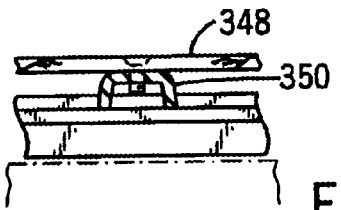
FIG. 16 is a partial section view taken along line 16—16 of FIG. 15.

FIGS. 15 and 16 illustrate an alternative floor member construction, shown at 46'. In this embodiment, floor member 46' includes an upper floor tile 348 secured to a series of spaced apart inverted U-shaped reinforcing members 350. Notches 352 are formed in reinforcing members 350 adjacent each end, and are adapted to be engaged by the upper ends of floor mounting walls 326 in the same manner as described with respect to floor member 46 in FIG. 14.

As also illustrated in FIG. 15, a ramp member 354 may be secured to each outermost rail member 44, for providing a smooth transition from floor 33 to the raised floor defined by floor members 46 between rail members 44. Ramp member 354 includes an inclined ramp wall 356 having a lower end which rests on floor 33 and which transitions into a horizontal upper wall 358 having the same elevation as outer lip 324 of rail member 44. A ramp support web 360 extends downwardly from horizontal upper wall 358, and includes an inverted mounting channel 362 which engages upper end 328 and lip 330 of floor mounting wall 326, to support ramp member 354 outwardly of rail member 44.

Figure 17:
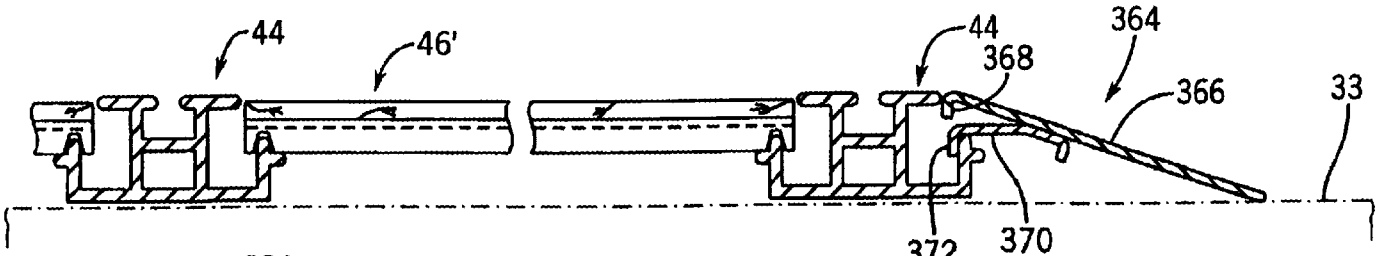
FIG. 17 is a view similar to FIG. 15, showing an alternative embodiment of a ramp adapted for connection to an endmost one of the rails.

FIG. 17 illustrates an alternative ramp member 364 which includes an inclined ramp wall 366 that rests at one end on floor 33. At the opposite end, inclined ramp wall 366 terminates in a downwardly extending vertical lip 368, and the upper end of ramp wall 366 is again at the same elevation as rail member lip 324. A clip 370 is secured to the underside of inclined ramp wall 366, and defines an engagement lip 372 which engages the upper end 328 of floor mounting wall 326 so as to secure ramp member 364 to rail member 44.

Figure 18:
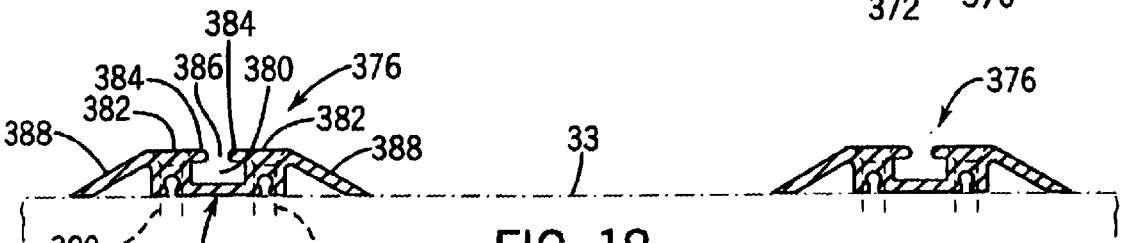
FIG. 18 is a section view of alternative low profile rail embodiment adapted to be incorporated into a mobile storage system as shown in FIG. 1.

FIG. 18 illustrates a pair of low profile rail members 376 which may be employed in place of rail members 44. Each low profile rail member 376 includes a body section 378 having a groove 380 configured similarly to groove 318 of rail member 44. Each low profile rail member 376 defines a pair of wheel engagement surfaces 382, and a pair of lips 384 extend inwardly toward each other over groove 380 for defining a space 386 in communication with groove 380. Low profile rail member 376 further includes a pair of integral inclined ramp sections 388 extending outwardly from wheel support surfaces 382, for providing a transition between floor 33 and wheel support surfaces 382.

In a typical application, low profile rail members 376 are connected to floor 33 using conventional floor anchors 390, or any other satisfactory securing mechanism.

Figure 19:
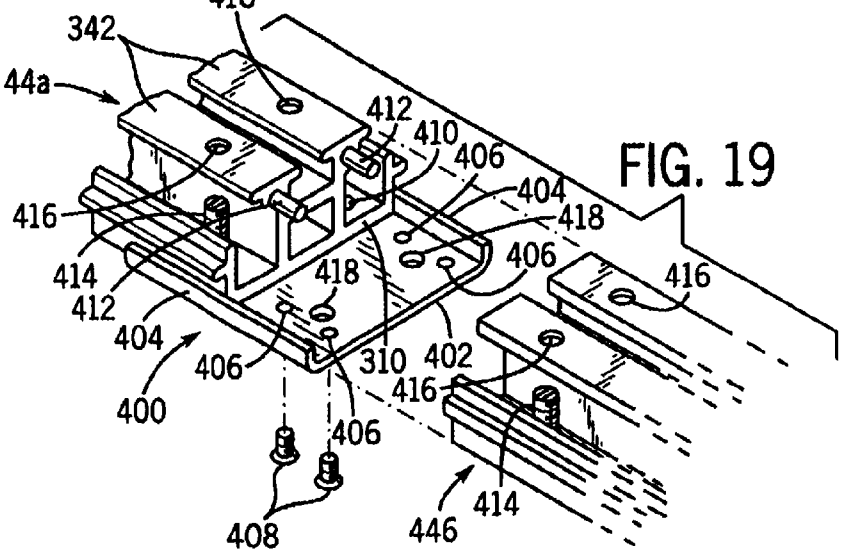
FIG. 19 is a partial isometric view illustrating one embodiment of a splice arrangement for connecting a pair of axially aligned rail sections together, for incorporation into the mobile storage system of FIG. 1.
Figure 20:
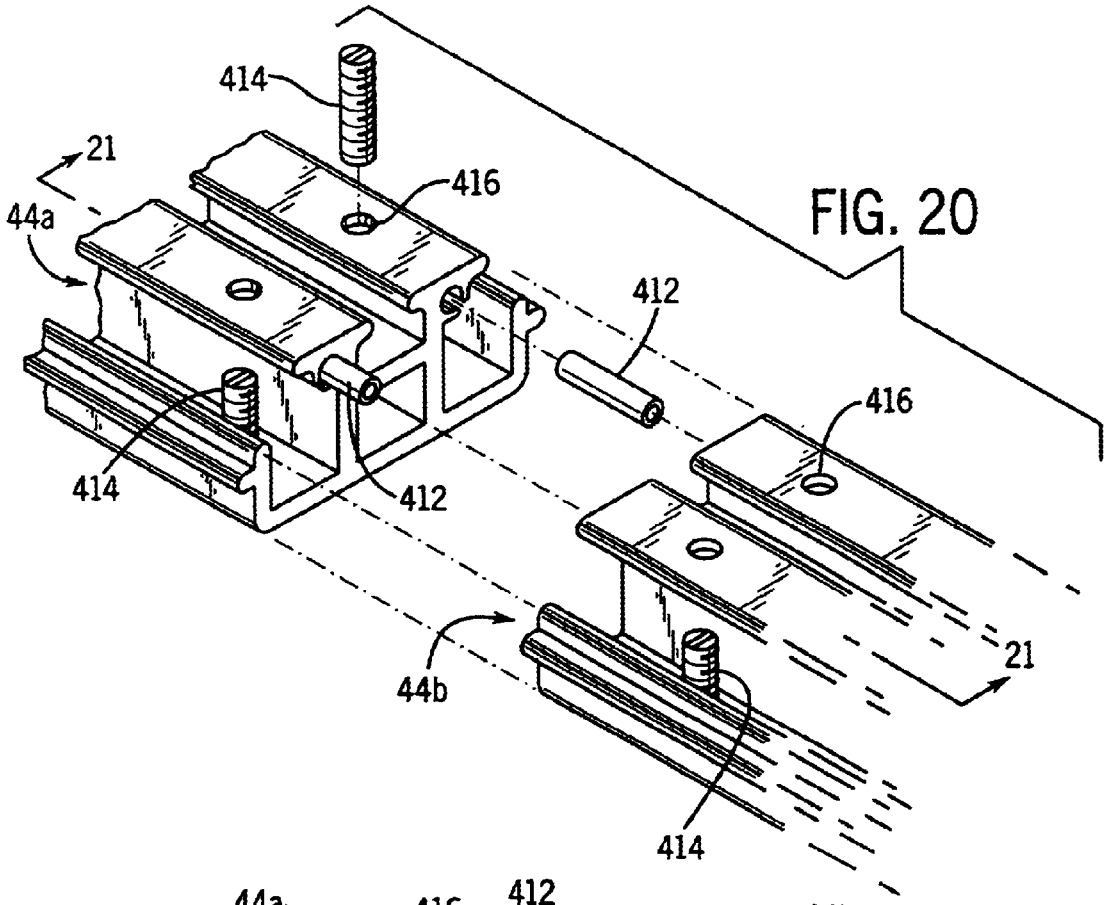
FIG. 20 is a view similar to FIG. 19, showing an alternative embodiment of a splice arrangement for interconnecting a pair of aligned rail sections together.
Figure 21:
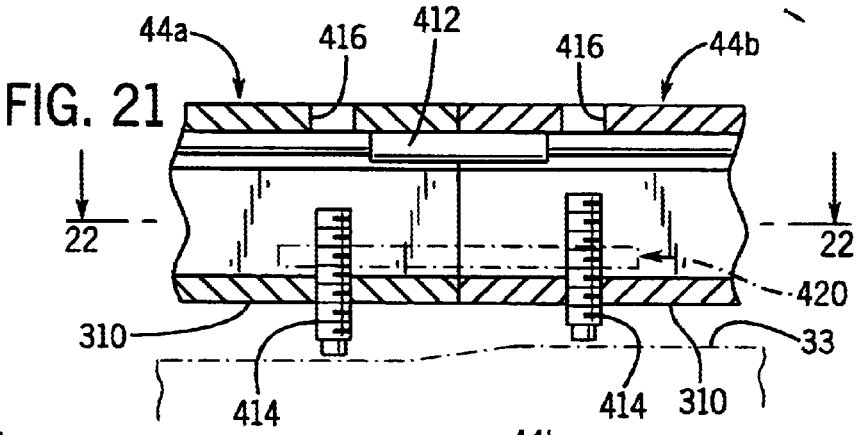
FIG. 21 is a partial section view taken along line 21—21 of FIG. 20.
Figure 22:
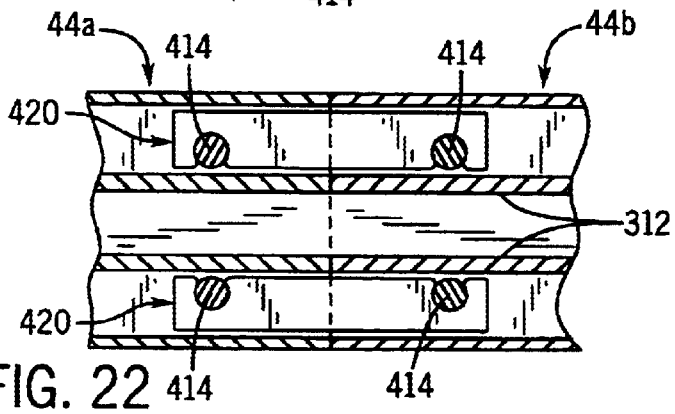
FIG. 22 is a partial section view taken along line 22—22 of FIG. 21.
Figure 23:
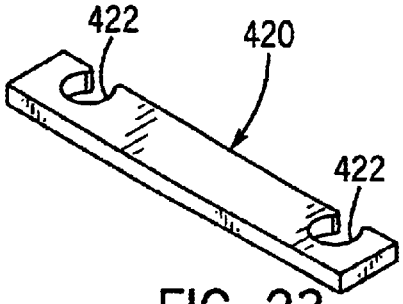
FIG. 23 is an isometric view of a splice connector incorporated in the rail splice arrangement illustrated in FIGS. 20–22.

FIG. 19 illustrates one embodiment of the manner in which a pair of rail sections, such as shown at **44*a*, 44*b*, are spliced or interconnected together in an aligned fashion so as to form a rail member 44. In this embodiment, a splice plate 400 underlies the adjacent ends of rail sections 44*a*, 44*b*. Splice plate 400 includes a horizontal wall 402 and a pair of upstanding flanges 404 located one at each end of horizontal wall 402. A pair of spaced apart connector holes 406 are located adjacent each flange 404. Threaded connectors, such as screws 408, are adapted to extend through connector holes 406 and into aligned threaded holes, such as 410, formed in rail member base 310. Connector holes 406 in horizontal wall 402 are countersunk so as to receive the heads of screws 408. With this arrangement, splice plate 400 and screws 408 function to maintain rail sections 44*a*, 44*b*** in end-to-end aligned relationship to each other.

In addition, a pair of alignment pins 412 are engaged within facing, aligned openings formed in the adjacent ends of rail sections **44*a*, 44*b*. Pins 412 function to interconnect rail sections 44*a*, 44*b* together at a location above splice plate 400, so as to maintain rail sections 44*a*, 44*b*** in alignment with each other.

As also shown in FIG. 19, rail members 44 are capable of being leveled on floor 33 using leveling screws 414 which are received within threaded openings formed in rail member base 310. Clearance holes 416 are formed in each rail member support surface 342, for providing access to the upper end of each leveling screw 414. Clearance holes 418 are also formed in splice plate outer wall 402, for allowing leveling screws 414 to be moved inwardly and outwardly so as to adjust the position of rail sections **44*a*, 44*b* relative to floor 33**.

While leveling screws 414 are illustrated as being located at the ends of rail sections **44*a*, 44*b*, it is understood that leveling screws 414 may be located at any point along the length of rail member 44, to provide the ability to adjust the elevation of rail member 44** throughout its length.

FIGS. 20–23 illustrate an alternative splice configuration, which incorporates pins 412 and leveling screws 414. In this embodiment, a splice clip 420 defines a pair of openings or recesses 422 within which leveling screws 414 of adjacent rail sections 44*a*, 44*b* are received. Pins 412 function to provide proper alignment of rail sections 44*a*, 44*b* relative to each other, and splice clip 420 functions to maintain the ends of rail sections 44*a*, 44*b* together when leveling screws 414 are engaged within recesses 422.

Figure 24:
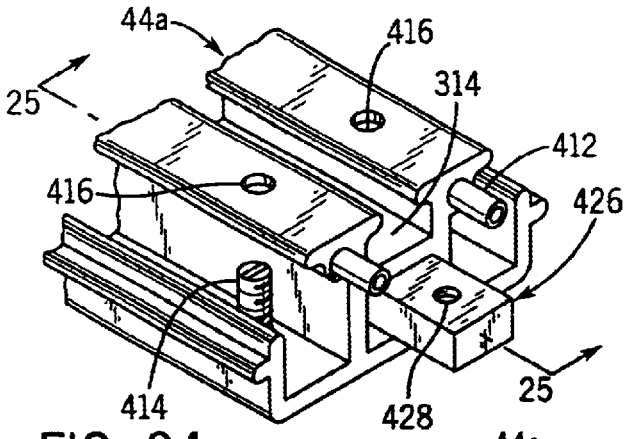
FIG. 24 is a view similar to FIG. 20, illustrating another embodiment of a splice arrangement for interconnecting a pair of aligned rail sections together.
Figure 25:
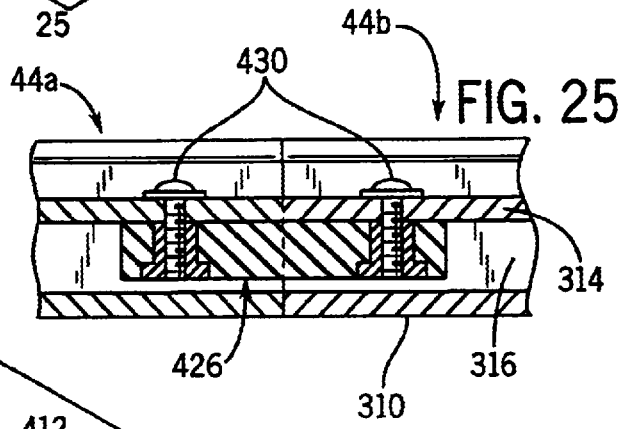
FIG. 25 is a partial section view taken along line 25—25 of FIG. 24.

FIGS. 24 and 25 illustrate another splice embodiment, which again incorporates pins 412 for providing proper alignment of rail sections 44*a*, 44*b*. In this embodiment, a splice bar 426 is received within the closed passages 316 defined by adjacent rail sections 44*a*, 44*b*. Splice bar 426 has a pair of vertical threaded passages 428, which may be formed by threaded inserts engaged with splice bar 426. Each threaded passage 428 is in alignment with an opening formed in transverse wall 314. Threaded fasteners, such as screws 430, are engaged within threaded openings 428 for maintaining rail sections 44*a*, 44*b* together.

Figure 26:
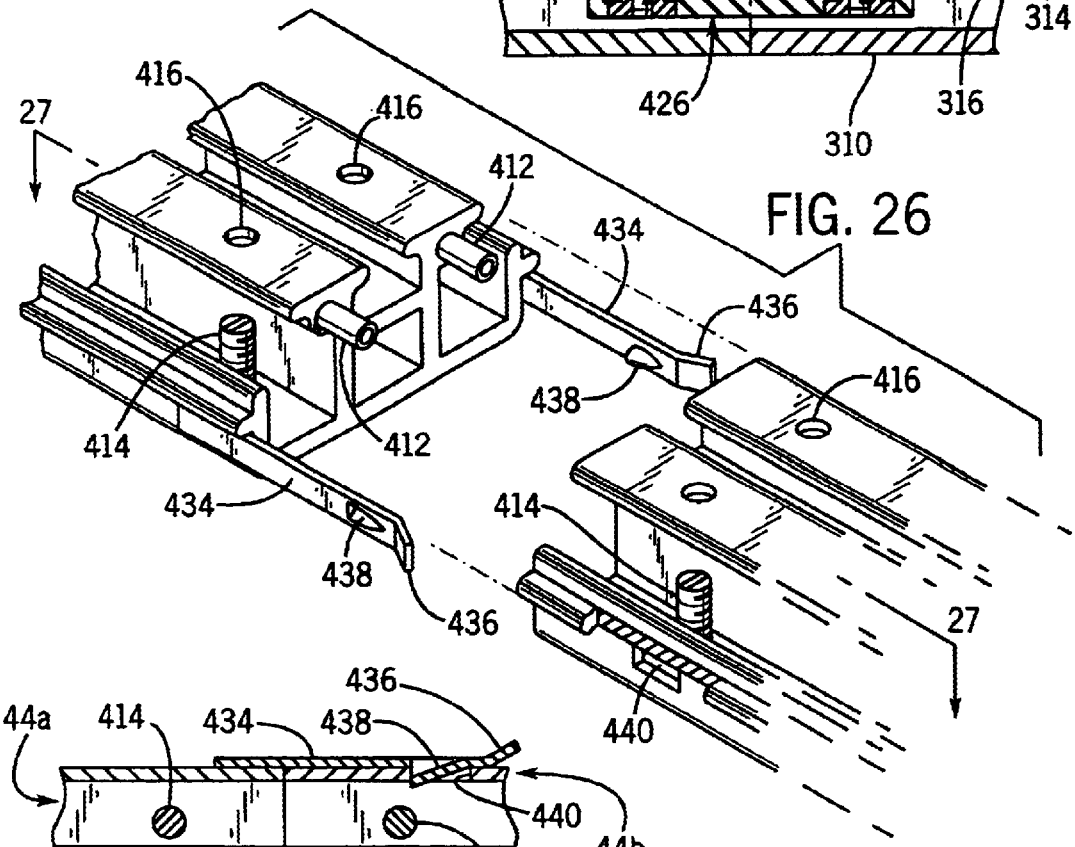
FIG. 26 is an isometric view of yet another embodiment of a splice arrangement for interconnecting aligned rail sections together.
Figure 27:
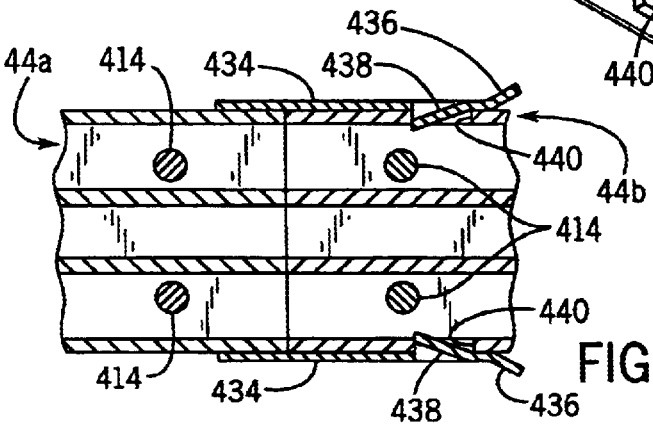
FIG. 27 is a partial section view taken along line 27—27 of FIG. 26.

FIGS. 26 and 27 illustrate yet another embodiment for splicing rail sections 44*a*, 44*b* together. In this embodiment, a pair of spring clips 434 are mounted to floor mounting wall 326. Each spring clip 434 includes a flared outer end 436 and an inwardly extending locking nib 438. An opening 440 is formed in rail section 44*b*. As rail sections 44*a*, 44*b* are slid together to insert pins 412, locking nib 438 is received within opening 440 so as to maintain rail sections 44*a*, 44*b* together.

Significantly, the rail systems of FIGS. 15 to 26 may be installed with relatively little effort in a standard office, for example, over existing carpet and without modification to the structural aspects of the floor such as would require substantial construction services.

The various components of the mobile storage system of the present invention are first produced at the manufacturer's plant and then shipped in a knocked-down fashion to the installation site. Some components may be subassembled prior to shipment, such as frames 50, cover tiles 52, mobile housing assemblies 53, bumper assemblies 150, and the input sprocket components of drive assembly 260 including mounting bracket 274. Alternatively, these components may be shipped in knocked-down form and assembled on site. In the case of mobile housing assemblies 53, wheel support members 104 are preferably welded to wheel housing members 54 prior to shipment.

In assembly, the user or installer first builds rail and floor system 32 to a desired width and depth by placing together a desired number of rail sections, such as 44*a*, 44*b* to construct a series of assembled rail members 44, each of which has a desired length. Floor members 46 are then engaged between each pair of adjacent rail members 44 as shown and described above, to form an assembled rail and floor system 32. The leveling screws, such as 416, associated with the rail members 44 are employed to attain a desired elevation of rail members 44 relative to floor 33. Similarly, the leveling screws of floor members 46 are employed to engage floor members 46 with floor 33 between rail members 44 and to level the floor members 46. The ramp members, such as 354, 364, are secured to the outermost rail members 44 as shown in FIGS. 15 and 17 so as to provide a transition from floor 33 to the raised floor defined by floor members 46.

If shipped in knocked-down fashion, mobile housing assemblies 53 are then assembled on site. Brace retainers 90 are inserted through slots 88 so that central mounting area 94 is located below top wall 64 of wheel housing member 54. Wheel assembly 68 is then inserted between sidewalls 66, such that upper edges 96 of mounting sections 84 engage the underside of central mounting area 94. During such movement of wheel assembly 68, stub shafts 76 are received within slots 86 in depending sidewalls 66. Screws 98 are then utilized to mount wheel assembly 68 to wheel housing member 54 by engagement within apertures 102 in bearing supports 80. Retainer members 130 are then mounted to the ends of wheel housing members 54, and a bumper assembly 150 is mounted to retainer member 130 as described above.

Once mobile housing assemblies 53 are assembled as described, either in pre-assembled form or on site, the installer proceeds with assembly of carriage assemblies 30. Carriage assemblies 30 are constructed as described above, by first constructing a "starter" module consisting of an end pair of mobile housing assemblies 53 and cross-brace members 190 extending therebetween, in combination with side cover members 58, an end cover member 60, and a drive shaft section 308. Additional "adder" modules are then assembled to the "starter" module, by connecting an additional pair of cross-brace members 190 between the end one of mobile housing assemblies 53 and another mobile housing assembly 53. Each "adder" module also includes a pair of side cover members 58 and a drive shaft section 308. As noted previously, each carriage module is constructed such that mobile housing assemblies 53 are spaced apart a distance which is equal to the spacing of rail members 44, which is also equal to the width of storage units 34.

To facilitate installation, mobile housing assemblies 53 are positioned on rails 44 during assembly of the remaining components of carriage assembly 30. Roller surface 72 defined by wheel 70 of each wheel assembly 68 is engaged with support surface 342 defined by rail members 44, and wheel guide flange 74 is received within space 322. In addition, each retainer tab 130 is engaged with its respective wheel support 104 such that retainer tab 140 of retainer member 130 is positioned within groove 318 defined by the rail member 44. Retainer tab 140 is configured such that neck section 138 is received within space 322, and lips 320 overlie the ends of retainer tab 140. With this arrangement, lips 320 and retainer tab 140 function to prevent carriage assembly 30 from upward movement relative to rail members 44. Any lateral forces exerted on carriage assembly 30 are borne by engagement of wheel guide flange 74 with the edges of lips 320, to ensure that neck section 138 of retainer member 130 is isolated from contact with the inner edges of inner lips 320.

Storage units 34 are then mounted to each carriage assembly 30 as described previously. The spacing between rail members 44 and the width of each module of carriage assembly 30 corresponds to the width of the storage unit 34, such that each storage unit 34 spans between and is supported by a pair of adjacent mobile housing assemblies 53. As shown and described with respect to FIG. 8, storage unit mounting section 142 of each retainer member 130 is utilized to connect adjacent ends of each of a pair of storage units 34 to one of mobile housing assemblies 53. At the endmost mobile housing assembly 53, the end of storage unit 34 is positioned on mobile housing assembly 53 and is secured to storage unit mounting sections 142 of retainer members 130 associated with the endmost mobile housing assembly 53.

The installer then positions end frame 50 above the end of carriage assembly 30 and outwardly of sidewalls 36 of the endmost storage units 34. Frame 50 is then screwed to sidewalls 36 using screws 246, and is also connected to carriage assembly 30 by engagement with storage unit mounting sections 142 of retainer members 130.

Input drive assembly 260 is then installed by first engaging drive chain 296 with input sprocket 262 and transfer sprocket 288. Spacer bars 287 are positioned such that the upper end of each spacer bar 287 is received within an opening formed in lower transverse wall 280 of mounting bracket 274, and the lower ends of spacer bars 287 are engaged with inner engagement wall 228 of lower frame member 214. Spacer bars 287 are positioned upright and parallel, and have a length which corresponds to the desired position of input sprocket 262 to provide an optimum degree of tension in drive chain 296. When spacer bars 287 are properly positioned in this manner, mounting bracket 274 is secured to sidewalls 36 of endmost storage units 34 using screws 286. Tile members 52 are then engaged with frame 50 as described above, and input handle 298 is then mounted to plate 300.

A canopy 43 is then mounted to top wall 38 of each storage unit 34. A canopy support member is screwed to storage unit top wall 38 and to the underside of canopy 43, such that canopy 43 is supported above top wall 38. Canopies 43 enhance the overall aesthetic appearance of the mobile storage system of the present invention. In addition, canopies 43 are configured so as to prevent items from being placed on top of storage units 34. This provides an advantageous feature for a mobile storage system as contemplated by the present invention, wherein the top of the mobile storage unit is accessible by a user. This is normally not a problem with conventional mobile storage systems, in that open shelving or bookcases typically have a top wall having a sufficient height to prevent users from placing objects on the top of the storage unit. In a system such as the present invention, it is more likely that objects may be placed on top of storage units 34, which could result in such objects being spilled or sliding off of the mobile storage units 34 in operation. While canopies 43 are illustrated as having an arcuate configuration, it should be understood that any other non-flat shape could be employed while providing similar functional and aesthetic characteristics as canopies 43.

The above description of carriage assemblies 30 pertains to carriage assemblies 30 which are movable on rails 44. As noted, many installations of the mobile storage system of the present invention will have certain end or interior carriages or platforms which support a series of storage units 34 but which are not movable on rails 44, to provide a fixed end for the mobile storage system. For a fixed platform installation such as this, each wheel assembly 68 is replaced with a suitable bracket which is screwed or otherwise fastened to the rail 44, to stationarily fix the carriage assembly 30 and its associated storage units 34 to rail and floor system 32.

It can thus be appreciated that the present invention provides a mobile storage system which is particularly well suited for drawer-type file cabinets. It should be understood, however, that other types of storage units, such as four-post shelves, bookcases or the like, can also be mobilized using the components of the mobile storage system of the present invention.

The present invention provides a mobile storage system which can be shipped in knock-down fashion to an installation site, and installed quickly and easily by the same type labor force typically employed to install furniture. The system can be easily expanded or contracted by adding or removing certain sections of the carriage assembly or rail and floor system at any time during or after initial installation.

Various alternatives and embodiments are contemplated as being within the scope of the following claims particularly pointing out and distinctly claiming the subject matter regarded as the invention.

We claim:

1. A method of constructing a mobile storage system on a supporting surface, comprising the steps:

providing a plurality of file cabinets, wherein each file cabinet includes a housing and a plurality of pull-out drawers movably mounted to the housing for movement between an open position and a closed position;

securing each file cabinet housing to a carriage, wherein each file cabinet housing is held by the carriage and wherein the drawers of each file cabinet are movable relative to the carriage between the open position and the closed position, wherein the carriage comprises a series of interconnected carriage sections, and wherein each file cabinet housing is secured to the carriage by securing each file cabinet housing to one of the carriage sections;

positioning a plurality of axially extending rails on the supporting surface;

movably mounting the carriage to the rails; and engaging a retainer arrangement between the carriage sections and the rails.

2. The method of claim 1, wherein each carriage section comprises a pair of spaced apart mobile housing members, each of which is movably supported on one of the rails, and wherein the step of securing each file cabinet housing to the carriage is carried out by securing each file cabinet housing to and between a pair of spaced apart mobile housing members.

3. The method of claim 2, wherein the step of providing a plurality of file cabinets is carried out by providing at least a pair of side-by-side file cabinets, and wherein the step of securing each file cabinet housing to and between a pair of spaced apart mobile housing members is carried out by securing the file cabinet housing of the pair of side-by-side file cabinets to a common mobile housing member which is operable to support the pair of side-by-side file cabinets on one of the rails.

4. The method of claim 1, wherein the carriage is constructed by providing a primary carriage section and adding an additional carriage section for each file cabinet to be secured to the carriage.

5. The method of claim 4, wherein each carriage section includes a pair of spaced apart mobile housing members, and wherein the step of adding a carriage section is carried out by securing a structural cross-brace assembly to and between each of a pair of mobile housing members.

6. The method of claim 1, wherein each carriage section comprises an interconnected pair of spaced apart mobile housing members, each of which is movably supported on one of the rails, and wherein the step of engaging a retainer arrangement between the carriage sections and the rails is carried out by securing a retainer member to each mobile housing member of the pair of mobile housing members, and engaging the retainer member with retainer structure defined by the rail.

7. The method of claim 6, wherein the step of securing the file cabinet housings to the carriage sections is carried out by securing each file cabinet housing to at least one of the retainer members.

8. The method of claim 1, wherein the plurality of file cabinets includes an endmost file cabinet, wherein the housing of the endmost file cabinet includes an upstanding sidewall, and further comprising the step of providing an end panel arrangement which includes a frame adapted to overlie at least a portion of the upstanding sidewall, wherein the frame defines an interior, and wherein the end panel arrangement further includes a cover arrangement demountably engaged with the frame for enclosing the interior defined by the frame.

9. The method of claim 8, wherein the step of providing the end panel arrangement includes interconnecting the frame with the upstanding sidewall of the endmost file cabinet and with the carriage.

10. The method of claim 1, wherein each file cabinet housing includes a substantially flat top wall, and further comprising the step of mounting a canopy member to the top wall, wherein the canopy member defines a non-flat upper surface.

11. A method of constructing a mobile storage system on a supporting surface, comprising the steps:

providing a plurality of file cabinets, wherein each file cabinet includes a housing and a plurality of pull-out drawers movably mounted to the housing for movement between an open position and a closed position, wherein the plurality of file cabinets includes an endmost file cabinet and wherein the housing of the endmost file cabinet includes an upstanding sidewall;

interconnecting an input drive arrangement to the sidewall of the endmost file cabinet, wherein the input drive arrangement includes a manually operable input member;

providing an end panel arrangement which includes a frame adapted to overlie at least a portion of the upstanding sidewall of the endmost file cabinet, wherein the frame defines an interior within which the input drive arrangement is located, and wherein the end panel arrangement further includes a cover arrangement demountably engaged with the frame for enclosing the interior defined by the frame, wherein the cover arrangement is configured so as to overlie the portion of the upstanding sidewall enclosed by the frame and to overlie the input drive arrangement while exposing the manually operable input member;

securing each file cabinet housing to a carriage, wherein each file cabinet housing is held by the carriage and wherein the drawers of each file cabinet are movable relative to the carriage between the open position and the closed position;

positioning a plurality of axially extending rails on the supporting surface; and movably mounting the carriage to the rails.

12. A method of constructing a mobile storage system on a supporting surface, comprising the steps:

providing a plurality of file cabinets, wherein each file cabinet includes a housing and a plurality of pull-out drawers movably mounted to the housing for movement between an open position and a closed position;

securing each file cabinet housing to a carriage, wherein each file cabinet housing is held by the carriage and wherein the drawers of each file cabinet are movable relative to the carriage between the open position and the closed position;

positioning a plurality of axially extending rails on the supporting surface by placing the rails on the supporting surface;

engaging one or more floor members to and between adjacent rails, wherein the floor members are operable to space the rails a predetermined distance apart from each other, wherein each floor member defines a pair of spaced apart side edges, a pair of spaced apart end edges, an upper surface and an underside, and wherein a pair of spaced apart grooves are formed in the underside defined by each floor member, wherein each groove is located adjacent one of the side edges of the floor member;

wherein each floor member is engaged to one of the rails without the use of fasteners by engaging a lip defined by each rail within one of the grooves in the underside of the floor member, wherein the distance between the grooves functions to control the spacing between the rails, and wherein the floor members are configured such that the end edges of adjacent floor members are adapted to be located adjacent each other so that the floor members cooperate to cover and overlie the area of the supporting surface between the rails; and movably mounting the carriage to the rails.

13. The method of claim 12, wherein the carriage comprises a series of interconnected carriage sections, and wherein the one or more floor members are configured so as to space the rails a predetermined distance apart from each other corresponding to a width defined by each carriage section.

14. A system for mobilizing a series of drawer-type storage units relative to a support surface, wherein each storage unit includes a housing and a series of pull-out drawers, wherein each drawer is movable between an open position and a closed position, comprising:

a carriage adapted to support the storage unit, wherein the carriage includes a series of interconnected axially extending mobile housing members;

a series of rails adapted for placement on the support surface, wherein the rails extend in a direction substantially parallel to the direction of movement of the drawers, and wherein the carriage is movable on the rails by engagement of each mobile housing member with one of the rails; and a retainer arrangement interposed between the carriage and the rails, comprising one or more rail engagement members interconnected with the carriage and including a retainer section, and axially extending engagement structure defined by the rail, wherein the retainer section is movably received within the engagement structure defined by the rail for preventing upward movement of the carriage relative to the rail, wherein the engagement structure defined by the rail comprises an upwardly facing channel in combination with at least one overlying lip, and wherein the retainer section of each rail engagement member comprises a retainer tab adapted for placement within the channel wherein the retainer tab is configured so as to engage the overlying lip to maintain the retainer tab within the channel to prevent upward movement of the carriage relative to the rails.

15. The system of claim 14, wherein each mobile housing member defines a pair of spaced apart ends, and wherein a rail engagement member is mounted toward each end of each mobile housing member.

16. A system for mobilizing a series of drawer-type storage units relative to a support surface, wherein each storage unit includes a housing and a series of pull-out drawers, wherein each drawer is movable between an open position and a closed position, comprising:

a carriage adapted to support the storage units, wherein the carriage includes a series of interconnected axially extending mobile housing members, wherein the carriage comprises a series of interconnected carriage sections and includes a pair of endmost mobile housing members and a plurality of interior mobile housing members located between the endmost mobile housing members, wherein each interior mobile housing member is common to a pair of adjacent carriage sections;

a series of rails adapted for placement on the support surface, wherein the rails extend in a direction substantially parallel to the direction of movement of the drawers, and wherein the carriage is movable on the rails by engagement of each mobile housing member with one of the rails; and a retainer arrangement interposed between the carriage and the rails, comprising one or more rail engagement members interconnected with the carriage and including a retainer section, and axially extending engagement structure defined by the rail, wherein the retainer section is movably received within the engagement structure defined by the rail for preventing upward movement of the carriage relative to the rail, wherein each mobile housing member defines a pair of spaced apart ends, and wherein a rail engagement member is mounted toward each end of each mobile housing member.

17. The system of claim 16, wherein each rail engagement member further includes a storage unit mounting section, wherein the storage unit mounting section of each rail engagement member is adapted for connection to the housing of one of the storage units for securing the storage unit to the carriage.

18. The system of claim 17, wherein each carriage section is adapted to support one of the storage units, wherein the storage unit mounting section of each rail engagement member associated with the interior mobile housing members is adapted for connection to the housing of each of a pair of adjacent storage units supported by the interior mobile housing member.

19. A system for mobilizing a series of drawer-type storage units relative to a support surface, wherein each storage unit includes a housing and a series of pull-out drawers, wherein each drawer is movable between an open position and a closed position, comprising:

a carriage adapted to support the storage units, wherein the carriage includes a series of interconnected axially extending mobile housing members;

a series of rails adapted for placement on the support surface, wherein the rails extend in a direction substantially parallel to the direction of movement of the drawers, and wherein the carriage is movable on the rails by engagement of each mobile housing member with one of the rails; and a retainer arrangement interposed between the carriage and the rails, comprising one or more rail engagement members interconnected with the carriage and including a retainer section, and axially extending engagement structure defined by the rail, wherein each mobile housing member defines a pair of spaced apart ends and wherein a rail engagement member is mounted toward each end of each mobile housing member, wherein the retainer section is movably received within the engagement structure defined by the rail for preventing upward movement of the carriage relative to the rail, wherein the engagement structure defined by the rail comprises an upwardly facing channel in combination with at least one overlying lip, and wherein the retainer section of each rail engagement member comprises a retainer tab adapted for placement within the channel, wherein the retainer tab is configured so as to engage the overlying lip to maintain the retainer tab within the channel to prevent upward movement of the carriage relative to the rails.

20. A system for mobilizing a series of drawer-type storage units relative to a support surface, wherein each storage unit includes a housing and a series of pull-out drawers, wherein each drawer is movable between an open position and a closed position, comprising:

a carriage adapted to support the storage units, wherein the carriage includes a series of interconnected axially extending mobile housing members;

a series of rails adapted for placement on the support surface, wherein the rails extend in a direction substantially parallel to the direction of movement of the drawers, and wherein the carriage is movable on the rails by engagement of each mobile housing member with one of the rails;

a retainer arrangement interposed between the carriage and the rails, comprising one or more rail engagement members interconnected with the carriage and including a retainer section, and axially extending engagement structure defined by the rail, wherein the retainer section is movably received within the engagement structure defined by the rail for preventing upward movement of the carriage relative to the rail;

wherein the carriage defines a pair of spaced apart ends, and wherein each of a pair of endmost storage units is adapted to be supported by the carriage adjacent one of the carriage ends, wherein at least one of the endmost storage units defines an outwardly facing upstanding sidewall; and an end panel arrangement located at one of the ends of the carriage, wherein the end panel arrangement includes a frame defining an interior and overlying at least a portion of the upstanding sidewall of one of the endmost storage units, and at least one cover member demountably engageable with the frame, wherein the cover member is configured to enclose the interior of the frame to conceal the portion of the upstanding sidewall of the endmost storage unit.

21. The system of claim 20, wherein the frame is mounted to the carriage end and to the upstanding sidewall of the endmost storage unit.

22. A system for mobilizing a series of drawer-type storage units relative to a support surface, wherein each storage unit includes a housing and a series of pull-out drawers, wherein each drawer is movable between an open position and a closed position, comprising:

a carriage adapted to support the storage units, wherein the carriage includes a series of interconnected axially extending mobile housing members;

a series of rails adapted for placement on the support surface, wherein the rails extend in a direction substantially parallel to the direction of movement of the drawers, and wherein the carriage is movable on the rails by engagement of each mobile housing member with one of the rails;

a retainer arrangement interposed between the carriage and the rails, comprising one or more rail engagement members interconnected with the carriage and including a retainer section, and axially extending engagement structure defined by the rail, wherein the retainer section is movably received within the engagement structure defined by the rail for preventing upward movement of the carriage relative to the rail;

wherein the carriage defines a pair of spaced apart ends, and wherein each of a pair of endmost storage units is adapted to be supported by the carriage adjacent one of the carriage ends, wherein each endmost storage unit defines an outwardly facing upstanding sidewall; and a drive system including an input drive member drivingly interconnected with the mobile housing members, and an input arrangement mounted to the upstanding sidewall of one of the endmost storage units and interconnected with the input drive member.

23. The system of claim 22, wherein the input arrangement of the drive system includes a rotatable input member rotatably mounted to an input mounting member, and wherein the input mounting member is mounted to the upstanding sidewall of one of the endmost storage units for securing the rotatable input member thereto, and wherein the drive system further includes a flexible input member drivingly engaged with the rotatable input member and the drive member for imparting rotation to the drive member in response to rotation of the rotatable input member.

24. The system of claim 23, further comprising a combination locating and support member interconnected with the input mounting member for positioning the input mounting member at a predetermined elevation relative to the carriage.

25. The system of claim 24, wherein the locating and support member is secured to the upstanding sidewall of the endmost storage unit along with the input mounting member.

26. A system for mobilizing a series of drawer-type storage units relative to a support surface, wherein each storage unit includes a housing and a series of pull-out drawers, wherein each drawer is movable between an open position and a closed position, comprising:

a carriage adapted to support the storage unit, wherein the carriage includes a series of interconnected axially extending mobile housing members;

a series of rails adapted for placement on the support surface in spaced apart relationship, wherein the rails extend in a direction substantially parallel to the direction of movement of the drawers, and wherein the carriage is movable on the rails by engagement of each mobile housing member with one of the rails;

a retainer arrangement interposed between the carriage and the rails, comprising one or more rail engagement members interconnected with the carriage and including a retainer section, and axially extending engagement structure defined by the rail, wherein the retainer section is movably received within the engagement structure defined by the rail for preventing upward movement of the carriage relative to the rail; and a series of floor members located between and engaged with adjacent rails, wherein the floor members and the rails include cooperating engagement structure which is operable to maintain the rails at a predetermined spacing, wherein each floor member defines a pair of spaced apart side edges, a pair of spaced apart end edges, an upper surface and an underside, and wherein a pair of spaced apart grooves are formed in the underside defined by each floor member, wherein each groove is located adjacent one of the side edges of the floor member;

wherein each floor member is engaged to one of the rails without the use of fasteners by engaging a lip defined by each rail within one of the grooves in the underside of the floor member, wherein the distance between the grooves functions to control the spacing between the rails, and wherein the floor members are configured such that the end edges of adjacent floor members are adapted to be located adjacent each other so that the floor members cooperate to cover and overlie the area of the supporting surface between the rails.

27. The system of claim 26, wherein the carriage comprises a series of interconnected carriage sections, wherein each carriage section includes a pair of mobile housing members and is adapted to support one of the storage units, and wherein each carriage section defines a width corresponding to the spacing between adjacent rails, such that each mobile housing member is movably supported by one of the rails.

28. A system for mobilizing a series of drawer-type storage units relative to a support surface, wherein each storage unit includes a housing and a series of pull-out drawers, wherein each drawer is movable between an open position and a closed position, comprising:

a carriage adapted to support the storage units, wherein the carriage includes a series of interconnected axially extending mobile housing members;

a series of rails adapted for placement on the support surface, wherein the rails are placed on the support surface in spaced apart relationship and extend in a direction substantially parallel to the direction of movement of the drawers, wherein the carriage is movable on the rails by engagement of each mobile housing member with one of the rails;

wherein the carriage comprises a series of interconnected carriage sections, wherein each carriage section includes a pair of mobile housing members and is adapted to support one of the storage units, and wherein each carriage section defines a width corresponding to the spacing between adjacent rails, such that each mobile housing member is movably supported by one of the rails;

wherein the carriage includes a pair of endmost mobile housing members and a plurality of interior mobile housing members located between the endmost mobile housing members, wherein each interior mobile housing member is common to a pair of adjacent carriage sections and wherein each interior mobile housing member is configured to support the housing of each of a pair of adjacent storage units;

a retainer arrangement interposed between the carriage and the rails, comprising one or more rail engagement members interconnected with the carriage and including a retainer section, and axially extending engagement structure defined by the rail, wherein the retainer section is movably received within the engagement structure defined by the rail for preventing upward movement of the carriage relative to the rail; and a series of floor members located between and engaged with adjacent rails, wherein the floor members and the rails include cooperating engagement structure which is operable to maintain the rails at a predetermined spacing.

29. A system for mobilizing a series of drawer-type storage units relative to a support surface, wherein each storage unit includes a housing and a series of pull-out drawers, wherein each drawer is movable between an open position and a closed position, comprising:

a carriage adapted to support the storage unit, wherein the carriage includes a series of interconnected axially extending mobile housing members;

a series of rails adapted for placement on the support surface, wherein the rails are placed on the support surface in spaced apart relationship and extend in a direction substantially parallel to the direction of movement of the drawers, and wherein the carriage is movable on the rails by engagement of each mobile housing member with one of the rails; and a retainer arrangement interposed between the carriage and the rails, comprising one or more rail engagement members interconnected with the carriage and including a retainer section, and axially extending engagement structure defined by the rail, wherein the retainer section is movably received within the engagement structure defined by the rail for preventing upward movement of the carriage relative to the rail; and a series of floor members located between and engaged with adjacent rails, wherein the floor members and the rails include cooperating engagement structure which is operable to maintain the rails at a predetermined spacing, wherein the cooperating engagement structure comprises a pair of grooves formed in an underside defined by each floor member, wherein each groove is located adjacent a side edge defined by the floor member, and an upstanding lip defined by each rail, wherein each lip is adapted to be received within one of the grooves for fixing the spacing between adjacent rails.

30. A carriage for a mobile storage system, comprising:

a series of spaced apart mobile members, wherein each mobile member includes an axially extending housing and a pair of spaced apart wheels rotatably mounted to the axially extending housing; and a structural cross-brace arrangement extending between and interconnected with the axially extending housing of each of a pair of adjacent mobile members;

wherein the carriage comprises a pair of endmost mobile members and a plurality of interior mobile members located therebetween, wherein each interior mobile member includes a pair of spaced apart brace mounting areas located one on each of a pair of sides defined by the axially extending housing, wherein the structural cross-brace arrangement includes a brace member secured to and extending between spaced brace mounting areas of each of a pair of adjacent interior mobile members.

31. The carriage of claim 30, wherein the cross-brace arrangement includes a pair of brace members connected to and extending between the axially extending housing of each of a pair of adjacent mobile members, wherein the pair of brace members cross each other at a location between the pair of mobile members.

32. The carriage of claim 31, wherein the brace members are arranged in an x-type configuration between the pair of adjacent mobile members.

33. The carriage of claim 30, wherein the axially extending housing of each interior mobile member defines first and second ends, wherein a first one of the brace mounting areas is located toward the first end and a second one of the brace mounting areas is located toward the second end, and wherein the brace member secured to the first brace mounting area of each of the mobile members is connected to the second brace mounting area of the adjacent mobile member, and wherein the brace member connected to the second brace mounting area of each mobile member is connected to the first brace mounting area of the adjacent mobile member.

34. A carriage for a mobile storage system, comprising:

a series of spaced apart mobile members, wherein each mobile member comprises an axially extending housing including a pair of spaced apart walls, and a pair of spaced apart wheels rotatably mounted between the spaced apart walls of the axially extending housing, wherein each wheel is rotatably mounted to the walls of the axially extending housing between a pair of wheel supports that extend between the spaced apart walls of the housing; and a structural cross-brace arrangement extending between and interconnected with the axially extending housing of each of a pair of adjacent mobile members.

35. The carriage of claim 34, wherein the housing defines a pair of spaced apart sidewalls, wherein each wheel support extends between and is interconnected to the sidewalls.

36. The carriage of claim 35, further comprising an end bumper interconnected with one of the wheel supports, wherein the end bumper extends outwardly from an end defined by the mobile member and is adapted to engage the end bumper of a mobile member of an adjacent carriage for maintaining a predetermined spacing between the adjacent carriages.

37. The carriage of claim 36, further comprising a retainer member secured between the wheel support and the end bumper.

38. The carriage of claim 34, wherein each wheel is rotatably mounted to an axle, and wherein the axle is engaged with a pair of bearings located one on either side of the wheel, and further comprising a pair of bearing supports, each of which is mounted to one of the bearings, and wherein the bearing supports are secured to the axially extending housing to mount the wheel to the axially extending housing.

39. The carriage of claim 34, wherein the structural cross brace arrangement includes a pair of brace members, wherein each brace member is secured to a brace mounting member associated with the housing of one of the mobile members.

40. A carriage for a mobile storage system, comprising:

a series of spaced apart mobile members, wherein each mobile member includes an axially extending housing and a pair of spaced apart wheels rotatably mounted to the axially extending housing between a pair of wheel supports, wherein the housing defines a pair of spaced apart sidewalls and wherein each wheel support extends between and is interconnected to the sidewalls;

a structural cross-brace arrangement extending between and interconnected with the axially extending housing of each of a pair of adjacent mobile members; and a retainer member secured to one of the wheel supports, wherein the retainer member includes a retainer tab movably engaged with a rail adapted to support each mobile member.

41. A carriage for a mobile storage system, comprising:

a series of spaced apart mobile members, wherein each mobile member includes an axially extending housing and a pair of spaced apart wheels rotatably mounted to the axially extending housing between a pair of wheel supports, wherein the housing defines a pair of spaced apart sidewalls and wherein each wheel support extends between and is interconnected to the sidewalls;

an end bumper interconnected with one of the wheel supports, wherein the end bumper extends outwardly from an end defined by the mobile member and is adapted to engage the end bumper of a mobile member of an adjacent carriage for maintaining a predetermined spacing between the adjacent carriages;

a retainer member secured between the wheel support and the end bumper, wherein the retainer member includes a mounting protrusion, and wherein the end bumper is engaged with the mounting protrusion for mounting the retainer member to the wheel support; and a structural cross-brace arrangement extending between and interconnected with the axially extending housing of each of a pair of adjacent mobile members.

42. A carriage for a mobile storage system, comprising:

a series of spaced apart mobile members, wherein each mobile member includes an axially extending housing and a pair of spaced apart wheels rotatably mounted to the axially extending housing between a pair of wheel supports;

a cover member extending between each pair of adjacent mobile members, wherein the cover member is secured to one of the wheel supports of each mobile member; and a structural cross-brace arrangement extending between and interconnected with the axially extending housing of each of a pair of adjacent mobile members.

43. A carriage for a mobile storage system, comprising:

a series of spaced apart mobile members, wherein each mobile member includes an axially extending housing and includes a pair of spaced apart wheels rotatably mounted to the axially extending housing, wherein each wheel is rotatably mounted to an axle, and wherein the axle is engaged with a pair of bearings located one on either side of the wheel;

a pair of bearing supports, each of which is mounted to one of the bearings, and wherein the bearing supports are secured to the axially extending housing to mount the wheel to the axially extending housing;

wherein the housing includes a top wall and a pair of spaced apart depending sidewalls, wherein each bearing support includes a top wall engagement area which is engageable with the top wall for preventing rotation of the bearing support relative to the housing; and a structural cross-brace arrangement extending between and interconnected with the axially extending housing of each of a pair of adjacent mobile members.

44. The carriage of claim 43, wherein each bearing support is interconnected with one of the sidewalls of the axially extending housing.

45. A carriage for a mobile storage system, comprising:

a series of spaced apart mobile members, wherein each mobile member includes an axially extending housing, wherein each mobile member includes a pair of spaced apart wheels rotatably mounted to the axially extending housing, wherein each wheel is rotatably mounted to an axle and wherein each axle is engaged with a pair of bearings located one on either side of the wheel, wherein the housing includes a top wall and a pair of spaced apart depending sidewalls, wherein each sidewall includes a slot within which the axle is received;

a pair of wheel supports extending between and interconnected to the sidewalls, wherein the wheel supports are located one on either side of the wheel;

a pair of bearing supports, each of which is mounted to one of the bearings, wherein the bearing supports are secured to the axially extending housing to mount the wheel to the axially extending housing; and a structural cross-brace arrangement extending between and interconnected with the axially extending housing of each of a pair of adjacent mobile members.

46. A carriage for a mobile storage system, comprising:

a series of spaced apart mobile members, wherein each mobile member includes an axially extending housing; and a structural cross-brace arrangement extending between and interconnected with the axially extending housing of each of a pair of adjacent mobile members, wherein the structural cross brace arrangement includes a pair of brace members, wherein each brace member is secured to a brace mounting member associated with the housing of one of the mobile members, wherein the housing includes a pair of spaced apart sidewalls, and wherein the brace mounting member comprises a transverse member extending through a slot formed in each of the sidewalls of the housing and defining a pair of brace mounting areas, each of which is located outwardly of one of the housing sidewalls.

47. The carriage of claim 46, wherein each mobile member includes a pair of wheel assemblies mounted to the housing, and wherein each transverse member is mounted to the housing at the location of one of the wheel assemblies.

48. The carriage of claim 47, wherein each wheel assembly includes a bearing support which engages the transverse member when the wheel assembly is secured to the housing to maintain the transverse member in engagement with the housing.

49. A method of assembling a carriage for a mobile storage system, comprising the steps of:

positioning a series of mobile support members in spaced apart relationship;

interconnecting adjacent mobile support members with each other by securing a structural cross-brace arrangement to and between the adjacent mobile support members;

wherein each mobile support member includes a housing defining first and second ends, and wherein the step of interconnecting adjacent mobile support members is carried out by connecting a pair of brace members between the housings of the adjacent mobile support members, wherein each brace member is connected toward the first end of one of the housings and toward the second end of an adjacent one of the housings; and securing a first cover member to and between the first ends of the housings of each of a pair of adjacent mobile support members, and securing a second cover member to and between the second ends of the housings of the pair of adjacent mobile support members.

50. The method of claim 49, wherein each mobile member includes a pair of spaced apart wheels rotatably mounted to the housing, and wherein the step of interconnecting the brace members with the mobile support members is carried out by connecting each brace member to the mobile support member housing at the location of one of the wheels.

51. In a mobile storage system including a mobile carriage adapted for movement on a support surface, wherein the carriage is adapted to support one or more storage units including an endmost storage unit, the improvement comprising:

an end panel arrangement located above the carriage base, wherein the end panel arrangement includes a frame adapted to overlie at least a portion of an upstanding wall defined by the endmost storage unit, wherein the frame defines an interior; and a cover arrangement demountably engaged with the frame for selectively enclosing the interior defined by the frame;

wherein the carriage is movable relative to the support surface by means of an input drive arrangement associated with the carriage, wherein the input drive arrangement is secured to the upstanding wall of the endmost storage unit and is located within the interior defined by the frame, and wherein the input drive input arrangement includes a manually operable input member;

wherein the frame is adapted for connection to the upstanding wall of the endmost storage unit, and wherein the cover arrangement includes one or more cover members that are configured so as to overlie the portion of the upstanding sidewall enclosed by the frame and to overlie the input drive arrangement while exposing the manually operable input member, so as to provide access to the manually operable input member.

52. The improvement of claim 51, wherein the cover members are demountably engaged with the frame by means of a releasable connection arrangement interposed between the frame and each cover member.

53. The improvement of claim 52, wherein each cover member comprises cover tiles defining an inwardly facing surface adapted to face the upstanding wall of the endmost storage unit, and an opposite outwardly facing surface, wherein the releasable engagement arrangement enables each tile to be selectively engaged with and disengaged from the frame.

54. A mobile storage system, comprising:

a mobile carriage;

a rail including axially extending engagement structure, wherein the carriage is movably supported on the rail;

a plurality of storage units supported by the mobile carriage; and at least one combination retainer and storage unit mounting member secured to the carriage, and including a storage unit mounting section to which the storage unit is mounted, and a retainer section movably engaged with the axially extending engagement structure of the rail, wherein the retainer section and the engagement structure of the rail are configured to prevent upward movement of the carriage relative to the rail.

55. The mobile storage system of claim 54, wherein the mobile carriage includes a series of spaced apart wheel housings, each of which includes one or more wheels engaged with and supported on one of the rails, and wherein the combination retainer and storage unit mounting member is secured to one of the wheel housings.

56. The mobile storage system of claim 55, further comprising a structural cross-brace arrangement extending between and interconnected with each of a pair of adjacent wheel housings.

57. The mobile storage system of claim 55, wherein the engagement structure of the rail comprises a groove and at least one overlying lip, and wherein the retainer section of the combination retainer and storage unit mounting member comprises a laterally extending retainer tab located within the groove and engageable with the overlying lip for preventing upward movement of the wheel housing.

58. The mobile storage system of claim 57, wherein the engagement structure of the rail comprises a pair of lips overlying the groove and defining a space therebetween in communication with the groove, and wherein the laterally extending retainer tab is interconnected with a neck area disposed within the space defined between the pair of lips.

59. The mobile storage system of claim 55, wherein the wheel housing includes a top wall, wherein at least one storage unit is engaged with the top wall for supporting the storage unit above the wheel housing, and wherein the storage unit mounting section of the combination retainer and storage unit mounting member extends above the top wall of the wheel housing for connection to the storage unit.

60. The mobile storage system of claim 59, wherein the storage unit mounting section comprises a mounting member engageable with a wall defined by the storage unit, wherein the mounting member is secured to the storage unit wall by means of a fastener extending therebetween.

61. The mobile storage system of claim 59, wherein the wheel housing further includes a pair of sidewalls depending from the top wall, and further comprising a wheel support extending between and interconnected with the sidewalls, wherein the combination retainer and storage unit mounting member is secured to the wheel support.

62. The mobile storage system of claim 59, wherein the top wall supports adjacent sides of each of a pair of storage units, and wherein the storage unit mounting section of the combination retainer and storage unit mounting member is connected to each of the storage units supported by the top wall.

63. The mobile storage system of claim 55, further comprising a bumper member supported by and extending outwardly from the combination retainer and storage unit mounting member.

64. A method of assembly for a mobile storage system including a series of rails and at least one a mobile carriage movably supported on the rails, comprising the steps of:

placing a plurality of storage units on the carriage;

connecting a combination anti-tip and storage unit mounting member to the carriage, including the step of engaging a retainer section defined by the combination anti-tip and storage unit mounting member with retainer structure defined by the rail; and securing at least one of the storage units to the combination anti-tip and storage unit mounting member.

65. The method of claim 64, wherein the mobile carriage includes a series of spaced apart interconnected wheel housings, each of which defines a top wall, wherein the step of placing the storage units on the mobile carriage is carried out by engaging a pair of storage units with each wheel housing top wall, and wherein the step of securing at least one of the storage units to the combination anti-tip and storage unit mounting member is carried out by securing a pair of storage units to the retainer section of the combination anti-tip and storage unit mounting member.

66. The method of claim 64, wherein the mobile carriage includes a series of spaced apart interconnected wheel housings, each of which includes a pair of sidewalls between which at least one wheel is located, and further includes a wheel support member extending between and interconnected with the sidewalls, and wherein the step of connecting the combination anti-tip and storage unit mounting member to the carriage is carried out by securing the combination anti-tip and storage unit mounting member to the wheel support member.

* * * * *